US007263318B2

(12) United States Patent
Nishihama et al.

(10) Patent No.: US 7,263,318 B2
(45) Date of Patent: Aug. 28, 2007

(54) IMAGE FORMING APPARATUS INCLUDING AN INDEX FEATURE FOR EXTENDING THE LIFE OF A PHOTOSENSITIVE MEMBER

(75) Inventors: Tadayoshi Nishihama, Abiko (JP); Fumitake Hirobe, Ushiku (JP); Akihiro Noguchi, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 89 days.

(21) Appl. No.: 11/249,630

(22) Filed: Oct. 14, 2005

(65) Prior Publication Data

US 2006/0083556 A1 Apr. 20, 2006

(30) Foreign Application Priority Data

Oct. 20, 2004 (JP) ..... 2004-306247

(51) Int. Cl.
*G03G 15/09* (2006.01)

(52) U.S. Cl. ..... 399/267

(58) Field of Classification Search ..... 399/267
See application file for complete search history.

(56) References Cited

U.S. PATENT DOCUMENTS 5,049,471 A * 9/1991 Higashiguchi et al. ..... 430/122
5,078,085 A * 1/1992 Fuji et al. ..... 399/236
6,975,825 B2 12/2005 Sakamaki et al. ..... 399/269
7,054,584 B2 5/2006 Hirobe ..... 399/269
2005/0106489 A1* 5/2005 Sugahara et al. ..... 430/120
2006/0222415 A1 10/2006 Hirobe ..... 399/265

FOREIGN PATENT DOCUMENTS

JP 5-303244 11/1993
JP 10-340030 12/1998

* cited by examiner

*Primary Examiner*—Quana Grainger
(74) *Attorney, Agent, or Firm*—Fitzpatrick, Cella, Harper & Scinto

(57) ABSTRACT

The image forming apparatus has an electrophotographic photosensitive member and a developing device for using a developer including toner and carrier, wherein the developing device develops an electrostatic image on a photosensitive member by putting the developer forming a magnetic brush on a developer bearing member including magnetic field generation device inside in contact with the photosensitive member, and when a contact pressure of the developer on the developer bearing member against the photosensitive member is P (Pa), a circumferential velocity of the developer bearing member is $V_{Sl}$ (mm/s), a circumferential velocity of the photosensitive member is $V_{Dr}$ (mm/s), and an elastic deformation ratio of the photosensitive member is W (%), a degree of sliding of the photosensitive member by the developer represented ranges from 650 to 60500.

16 Claims, 10 Drawing Sheets

IMAGE FORMING APPARATUS INCLUDING AN INDEX FEATURE FOR EXTENDING THE LIFE OF A PHOTOSENSITIVE MEMBER

BACKGROUND OF THE INVENTION

1. Field of the Invention

The present invention relates to an image forming apparatus of an electrophotographic method, such as a printer, a copier or a facsimile.

2. Related Background Art

Conventionally, an image forming apparatus of an electrophotographic method exposes a uniformly charged electrophotographic photosensitive member (hereafter referred to as a "photosensitive member") according to an image information signal and forms an electrostatic image (latent image), which is developed with a developer into a toner image to be eventually transferred to a recording material such as paper. Thereafter, the toner image transferred on the paper is fixed by using heat and pressure. The photosensitive member is cleaned by removing the developer and so on left on the transfer with cleaning means so as to move on to a charging step again and form the image.

Such an image forming apparatus may have charging means for uniformly charging the photosensitive member by using a discharge phenomenon such as a corona discharge or a discharge between minute gaps near a contact portion of a roller and the photosensitive member (discharge means). The discharge means as above may also be used as transfer means for transferring the toner image formed on an image bearing member (such as a photosensitive member or an intermediate transferring medium) to a transfer material such as the recording material or intermediate transferring medium. A discharge by using such discharge means generates discharges such as nitrogen oxide (hereafter referred to as "NOx") and ozone, which partially adhere to a surface of the photosensitive member.

Thus, of the discharges adherent to a surface layer of the photosensitive member, NOx remaining on the surface layer of the photosensitive member generates nitric acid by reacting with moisture in the air or generates metal nitrate by reacting with a metal. If the nitric acid or nitrate thus generated is formed as a thin film on the surface of the photosensitive member, an electrical resistance value on the surface of the photosensitive member is reduced by moisture absorption of the nitric acid or nitrate. There are the cases where the electrostatic image formed on the photosensitive member is thereby destroyed and a quality of a formed image is lowered. Under a high-humidity environment in particular, an abnormal image as if the image is deleted (image deletion) is apt to be generated.

In the case of using a conventional organic photosensitive member, the surface layer of the photosensitive member is scraped away by an infinitesimal amount, on using a two-component developer including nonmagnetic toner particles (toner) and magnetic carrier particles (carrier) as the developer, by sliding the photosensitive member with a magnetic brush of a magnetic carrier in a development portion (development nip) or sliding the photosensitive member with a cleaning member such as a blade-like member for removing the toner left on the transfer remaining on the photosensitive member. And the above-described discharges and the nitric acid or metal nitrate generated by reaction thereof are removed on having the surface layer of the photosensitive member scraped away. Thus, it is conventionally possible to suppress generation of the abnormal image by Nox to a certain extent.

However, there is a problem of reducing life of the photosensitive member in the case of thus scraping away the surface of the photosensitive member with the magnetic brush of the magnetic carrier in the development portion or the cleaning member.

Thus, there has been a devised method whereby the photosensitive member having an photoconductive layer on its surface has a layer thickness thereof thickened to earn the life of the photosensitive member to a certain extent even in the case where sliding is performed with the magnetic brush of the magnetic carrier in the development portion or the cleaning member. If the layer thickness of the photoconductive layer is excessively thickened by this method, however, there is a problem that diffusion of optical carrier occurring on image exposure is increased and resolution is reduced. Therefore, it is difficult, in this case, to extend the life of the photosensitive member while maintaining a higher image quality. Furthermore, if a sliding force of the magnetic brush of the magnetic carrier in the development portion or the cleaning member is increased, there is a possibility of generating a scratch affecting image forming on the surface layer of the photosensitive member. If the sliding force of the cleaning member is increased, there is also a possibility that the cleaning member itself may have a defect such as a chip leading to insufficient cleaning.

To attain both the above-mentioned higher image quality and extended life, there is a proposal of a photosensitive member having a harder surface which can reduce a scraped-away amount of the photoconductive layer itself of the photosensitive member even in the case where sliding is performed with the magnetic brush of the magnetic carrier in the development portion or the cleaning member to remove the discharges (Nox). As for such photosensitive members, there are a photosensitive member having a protective layer provided on the surface layer to protect an organic photoconductive layer and an $\alpha$-Si photosensitive member. These photosensitive members have their surface layers hardened and so the scraped-away amount due to mechanical sliding is naturally reduced. Therefore, it is possible to reduce a film thickness of the photoconductive layer and protective layer on creation and decrease the diffusion of optical carrier occurring on image exposure so as to attain both the higher image quality and extended life.

However, in the case of reducing the scraped-away amount of the photoconductive layer itself, there is a possibility, according to the conventional method, that it may become difficult to scrape away the film of the nitric acid or nitrate formed on the photosensitive member. It is because, according to the conventional method, the surface layer of the photosensitive member in a lower part of the film of the nitric acid or nitrate is scraped away even though a little so as to scrape away and remove the film of the nitric acid or nitrate formed on the photosensitive member. To be more specific, in the case where the scraped-away amount of the surface layer of the photosensitive member is relatively large, it is possible to scrape away the film of the nitric acid or nitrate in its entirety including the surface layer of the photosensitive member. However, it becomes difficult to scrape away the film of the nitric acid or nitrate if the scraped-away amount of the surface layer of the photosensitive member is reduced.

Thus, there are proposals of various methods of solving the problems of the discharges by working on the discharges before they adhere to the photosensitive member rather than the above-mentioned methods of scraping away the surface of the photosensitive member. For instance, Japanese Patent Application Laid-Open No. H10-340030 discloses an image forming apparatus for preventing reduction in charging characteristics due to ozone by using a method of exhausting the ozone generated by the discharge outside the apparatus by exhaust means. Japanese Patent Application Laid-Open No. H05-303244 discloses an image forming apparatus for preventing the NOx generated by the discharge from becoming the nitric acid by using a method of providing heating means for preventing dew condensation which prevents dew drops from being generated on the photosensitive member.

In addition, there are proposals of a charging device for decomposing the NOx generated by the discharge by concurrently providing a creeping glow discharge device on the same board of a discharge electrode for charging, a corona generating device for absorbing the NOx by coating a shield as a component of the corona generating device with an alkaline film for neutralizing the NOx or a corona generating device provided with a photocatalytic substance capable of decomposing the discharges such as the ozone and NOx in a casing of the corona generating device in a form of a porous body structure.

As for the above methods, however, the devices themselves require space and cost. Therefore, the image forming apparatus in demand is the one of a simple configuration capable of removing the discharges adherent to the photosensitive member while extending the life of the photosensitive member.

SUMMARY OF THE INVENTION

An object of the present invention is to provide an image forming apparatus capable of removing discharges adherent to a photosensitive member while extending life of the photosensitive member.

An image forming apparatus in a desirable form for attaining the object is the one comprising:

electrostatic image forming means for charging an image bearing member and forming an electrostatic image;

developing means for contact-developing the electrostatic image with a developer including toner and carrier;

the developing means including magnetic field generation means inside and also including a developer bearing member for bearing and carrying the developer to a surface, wherein:

when a contact pressure of a borne developer against the image bearing member is P (Pa);

a circumferential velocity of the developer bearing member is Vsl (mm/s);

a circumferential velocity of the image bearing member is VDr (mm/s); and an elastic deformation ratio of the image bearing member is W (%), an index S indicating a degree of sliding defined by the following formula is within a range of 650≦S≦60500.

$$S = P \times \left\{ \frac{|v_{S1} - v_{Dr}|}{v_{Dr}} \right\} \times \{8.50 \times 10^5 \times \exp(-0.32W)\}.$$

Another image forming apparatus in a desirable form of the present invention is the one comprising:

electrostatic image forming means for charging an image bearing member and forming an electrostatic image;

developing means for contact-developing the electrostatic image with a developer including toner and carrier;

the developing means including magnetic field generation means inside and also including a developer bearing member for bearing and carrying the developer to a surface, wherein:

when a gap between the developer bearing member and the image bearing member is $G_{SD}$ [μm];

a magnetic amount of the carrier on applying a magnetic field of 100 mT is M[A/m];

a magnetic flux density of a magnetic pole opposed to the photosensitive member provided to the magnetic field generation means is B[mT];

a developer amount per unit area on the developer bearing member is C [mg/cm$^2$];

an angle of a half-value width of a magnetic flux density of the magnetic pole opposed to the image bearing member provided to the magnetic field generation means is H[°];

a conversion coefficient is α[1/Pa$^4$];

a circumferential velocity of the developer bearing member is $V_{S1}$ [mm/s];

a circumferential velocity of the image bearing member is $V_{Dr}$ [mm/s]; and an elastic deformation ratio of the image bearing member is W [%], an index S indicating a degree of sliding defined by the following formula is within a range of 650≦S≦60500.

$$S = \{fa(G_{SD}) \times fb(M) \times fc(B) \times fd(C) \times fe(H) \times \alpha\} \times \left\{ \frac{|v_{S1} - v_{Dr}|}{v_{Dr}} \right\} \times \{8.50 \times 10^5 \times \exp(-0.32W)\}$$

wherein:

fa ($G_{SD}$)[Pa]=$1.0787315 \times 10^3 \times \exp(-3.50 \times 10^{-3} \times G_{SD})$ fb (M)[Pa]=$1.1768499 \times 10^{-6} \times M$ fc (B)[Pa]=$1.8730701 \times 10^{-2} \times B$ fd (C)[Pa]=$6.246836 \times 10^{-1} \times C$ fe (H)[Pa]=$4.1580196 \times H$ and α[1/Pa$^4$]=$8.17774 \times 10^{-10}$

DETAILED DESCRIPTION OF THE EMBODIMENTS

Figure 1:
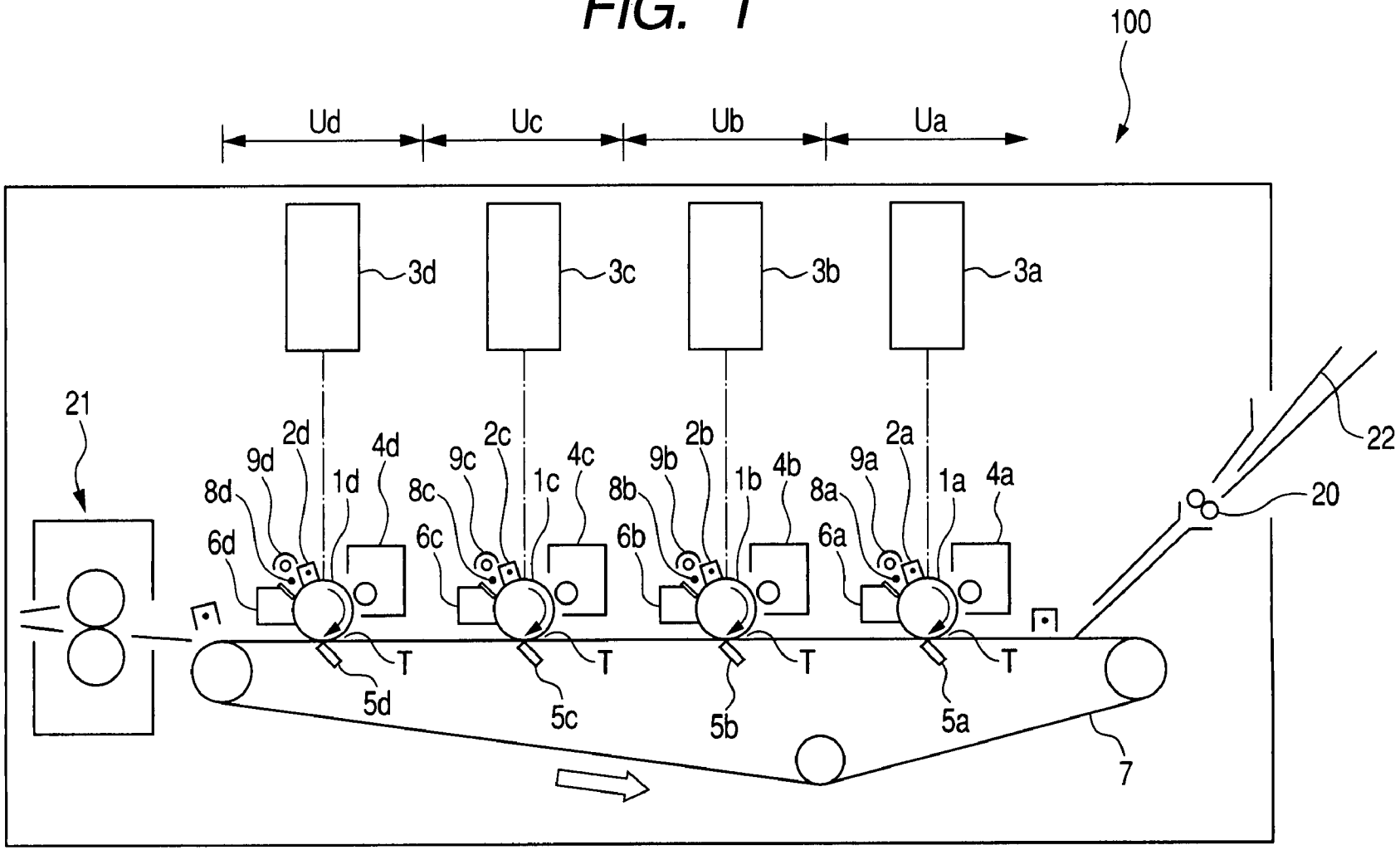
FIG. 1 is an overview sectional block diagram of an example of an image forming apparatus to which the present invention is applicable.

Hereunder, an image forming apparatus according to the present invention will be described further in detail by referring to the drawings.

First Embodiment

[Overall Configuration and Operation of the Image Forming Apparatus]

FIG. 1 shows an overview configuration of an embodiment of the image forming apparatus according to the present invention. An image forming apparatus 100 of this embodiment is a multicolor electrophotographic copier having four image forming units (image forming portions) Ua, Ub, Uc and Ud as image forming means. The image forming apparatus 100 can form a full-color image in four colors (yellow, magenta, cyan and black) on a recording material (recording paper, a plastic film, a cloth and so on) by an electrophotographic method according to an image information signal from a document scanner (not shown) connected to the image forming apparatus proper or a host device such as a personal computer communicably connected to the image forming apparatus proper.

According to this embodiment, the four image forming units Ua, Ub, Uc and Ud provided to the image forming apparatus 100 have substantially the same configuration except that development colors are different. Therefore, a general description will be given hereafter by omitting subscripts a, b, c and d for representing an element belonging to one of the image forming units in the case where no distinction is required in particular.

The image forming unit U has a cylindrical photosensitive member (photoconductive drum) 1 as an image bearing member, and also has a primary charging device 2 as charging means, a laser beam exposure apparatus (laser scanner apparatus) 3 as exposure means, a developing device 4 as development means, a transfer charger 5 as transfer means and a cleaner 6 as cleaning means placed around it. This embodiment uses a corona discharger as the primary charging device 2.

Furthermore, an endless carrier belt 7 is placed as recording material carrying means below the photosensitive members 1*a*, 1*b*, 1*c* and 1*d* in a form penetrating the image forming units Ua, Ub, Uc and Ud in FIG. 1. The carrier belt 7 can go round being hung on multiple rollers. The transfer charger 5 is placed at a location opposed to the photosensitive member 1 via the carrier belt 7. A transfer portion (transfer nip) T is formed by the photosensitive member 1 and carrier belt 7 at the location where the transfer charger 5 is placed. The carrier belt 7 supports a recording material 22 supplied into the image forming apparatus proper by a recording material supply roller 20 and carries it so as to have it contact the photosensitive member 1 at the location where the transfer charger 5 is placed.

Furthermore, to charge and entirely expose the photosensitive member 1 simultaneously, an auxiliary charger 8 and a neutralization lamp 9 are provided to be overlapping vertically at the same location on the surface of the photosensitive member 1.

Next, a description will be given as to an image forming process of the image forming apparatus of this embodiment. Toner remaining on the surface of the photosensitive member 1 is removed by the cleaner 6. Thereafter, the photosensitive member 1 is charged by the auxiliary charger 8 to have the same polarity (negative polarity in this embodiment) as an electrostatic latent image formed on the photosensitive member 1, and is uniformly exposed by the neutralization lamp 9. Thus, both of a memory effect area and a normal area have electricity removed so as to have a surface potential of approximately 0V. Thereafter, the photosensitive member 1 is uniformly charged by the primary charger 2. Next, the laser beam exposure apparatus 3 operates to form on the photosensitive member 1 an electrostatic image (latent image) corresponding to an image exposure pattern according to the image information color-separated into development colors of the image forming units U. The electrostatic images formed on the photosensitive members 1 are developed by the toner in yellow, magenta, cyan and black by operation of the developing devices 4 in the image forming units Ua, Ub, Uc and Ud to be rendered as visible images as toner images respectively. Thereafter, as the transfer chargers 5 operate, the visible images formed on the photosensitive members 1 are sequentially transferred onto the recording material 22 supported on the carrier belt 7 along with movement of the carrier belt 7 so as to form full color on the recording material 22.

The recording material 22 having the full-color toner image transferred thereon is separated from the carrier belt 7 thereafter, and is carried to a fixing device 21 as fixing means. The fixing device 21 heats and pressurizes the recording material 22 so as to fix the toner image thereon on the recording material 22. The recording material 22 having the toner image fixed thereon is ejected outside the image forming apparatus proper thereafter.

Figure 3:
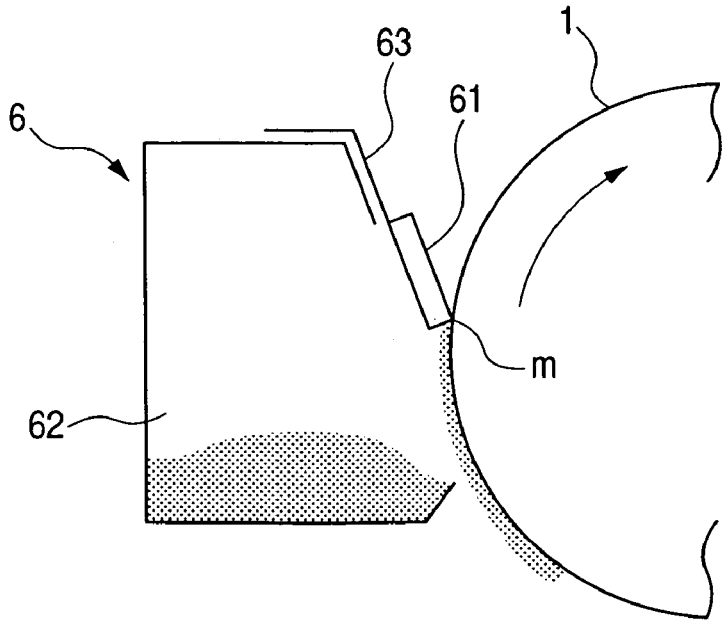
FIG. 3 is an overview sectional view of a cleaner provided to the image forming apparatus of FIG. 1.

Foreign substances such as the toner remaining on the photosensitive members 1 after the process for transferring the toner image to the recording material 22 are removed by a cleaning member 61 (FIG. 3) provided to the cleaner 6, and the photosensitive members 1 are repeatedly used for image formation.

It is also possible to form an image in a desired single color or desired multiple colors by operating only desired image forming units.

[Developing Device]

Figure 2:
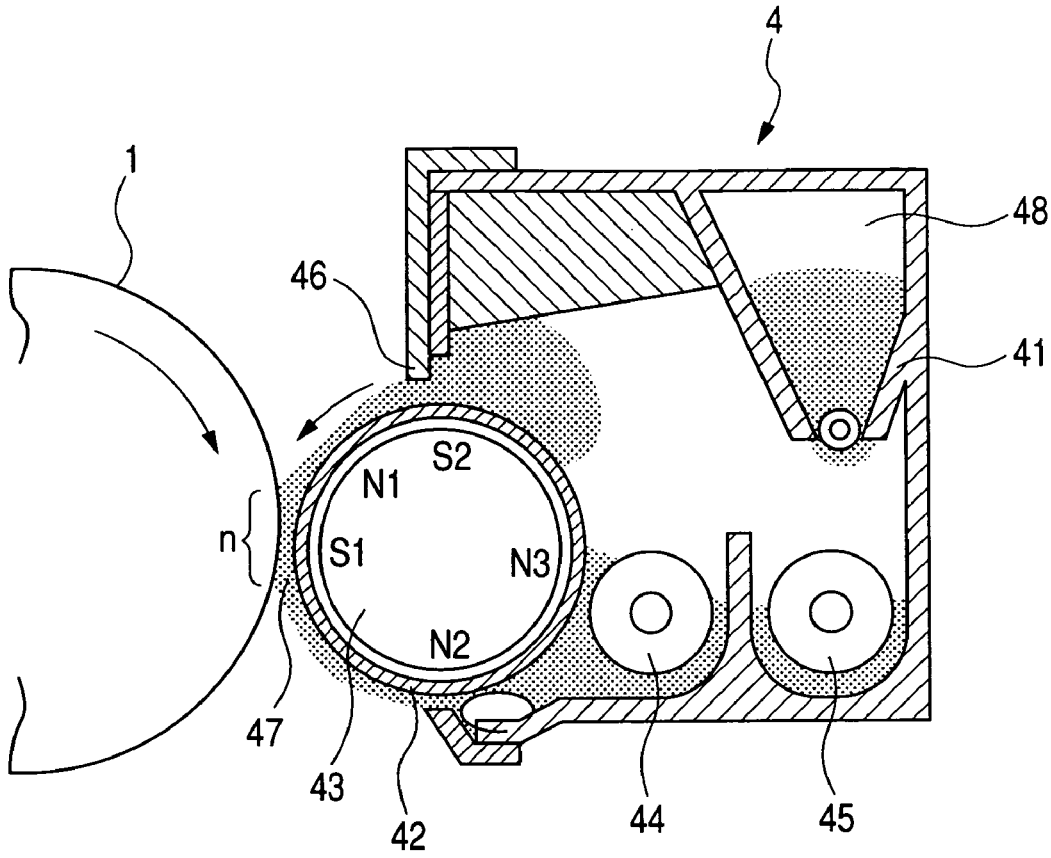
FIG. 2 is an overview sectional view of a development apparatus provided to the image forming apparatus of FIG. 1.

The developing device 4 will be further described by referring to FIG. 2. The developing device 4 of this embodiment adopts a two-component contact development method (two-component magnetic brush contact development method).

The developing device 4 basically consists of a development container 41 accommodating a two-component developer having mixed nonmagnetic toner particles (toner) and magnetic carrier particles (carrier) which is provided with a developing sleeve 42 as a developer bearing member for supporting the developer and carrying it to a development portion (development nip, development area) n opposed to the photosensitive member 1, a magnet roller 43 as magnetic field generation means irrotationally placed in the developing sleeve 42, agitator screws 44 and 45 for circulating the developer in the development container 41 and supplying it to the developing sleeve 42, and a regulation blade 46 for regulating the developer on the developing sleeve 42 and forming it into a thin layer.

The developing sleeve 42 is placed so that the closest area to the photosensitive member 1 normally has spacing ($G_{SD}$) (described in detail later) of 100 to 1000 μm (400 to 500 μm is frequently used in general), and is extended over the entire axial length of the photosensitive member 1 along an axis line direction (orthogonal direction to a surface movement direction) of the photosensitive member 1. And a magnetic brush 47 of the developer on the developing sleeve 42 forms a nip (development portion, development area) n with the photosensitive member 1 in the area opposed to the photosensitive member 1 so as to perform development in a state of contacting the surface of the photosensitive member 1. In this embodiment, the developing sleeve 42 rotates in a forward direction to a rotation direction of the photosensitive member 1 as indicated by an arrow in FIG. 2. To be more specific, the magnetic brush 47 forms the nip (development portion, development area) n of a width from a contact start position on an upstream side in the rotation direction of the developing sleeve 42 to a contact end position on a downstream side.

The magnet roller 43 as the magnetic field generation means has multiple magnetic poles in a circumferential direction, that is, five magnetic poles of N1, N2, N3, S1 and S2 (N denotes an N pole of magnet and S denotes an S pole of magnet) in this embodiment. The developer (two-component developer) in the development container 41 is pumped up on the rotating developing sleeve 42 by a magnetic force of the magnetic pole N3 of the magnet roller 43. In the process of sequentially carrying it to N3, S2 and N1, its layer thickness is regulated by the regulation blade 46 placed almost vertically to the developing sleeve 42 so that a thin layer of the developer is formed on the developing sleeve 42. The developer formed into the thin layer is carried to the development portion n along with the rotation of the developing sleeve 42, and forms the magnetic brush 47 on the surface of the developing sleeve 42 near a development main pole S1 of the magnet roller 43 due to its magnetic force.

The magnetic brush 47 contacts the surface of the photosensitive member 1 in the development portion n. And the toner selectively adheres to the electrostatic latent image of the photosensitive member 1 from within the developer so that the electrostatic image on the photosensitive member 1 is visualized as the toner image. The developer having finished the development is returned inside the development container 41 by the developing sleeve 42, and is separated from the developing sleeve 42 to be recovered inside the development container 41 by a reaction magnetic field formed by the magnetic poles N2 and N3 of the magnet roller 43.

On development, the developing sleeve 42 has a developing bias superimposing an AC voltage on a DC voltage applied thereto from a power supply (not shown). This embodiment applies the developing bias superimposing an AC voltage of frequency Vf=3000 Hz, peak-to-peak voltage (amplitude) Vpp=1500 V on a DC voltage Vdc=−500 V.

As for the developer in the development container 41, the toner is consumed by the development and so toner concentration (mixture ratio of the toner and carrier) gradually decreases. The toner concentration of the developer in the development container 41 is detected by unshown concentration detection means, and control is exerted so that, in the case where the toner concentration is reduced to a predetermined tolerance lower-limit concentration, the toner is replenished from a toner replenishment portion 48 connected to the development container 41 to keep the toner concentration of the developer within the predetermined tolerance limit.

The toner may be colored resin particles (including a binding resin, a colorant and other additives as required) themselves or colored particles having extra additives like colloidal silica fine powder externally added thereto. As for the carrier, it uses resin magnetic particles formed by dispersing magnetite as a magnetic material in a resin and dispersing a conductive body such as carbon black for the sake of conductivity and resistance adjustment, simple magnetite such as ferrite having its surface oxidized, reduced and resistance-adjusted or simple magnetite such as ferrite having its surface coated with a resin and resistance-adjusted.

This embodiment uses as the toner a negative charged toner of volume average particle diameter of 6 μm. This embodiment uses as the carrier the resin magnetic particles of average particle diameter of 35 μm. And this embodiment has the mixture ratio of the toner and carrier in the developer of 8:92 as a weight ratio. The volume average particle diameter of the toner is measure by the following measuring method. A Coulter counter TA-II (manufactured by Coulter) is used as a measuring apparatus, and an interface (manufactured by Nikkaki) and a CX-i personal computer (manufactured by Canon) for outputting number-of-pieces average distribution and volume average distribution are connected thereto. As for an electrolyte, a NaCl solution of 1 percent is confected by using a primary sodium chloride. A surface acting agent or preferably alkyl benzene sodium sulfonate is added as a dispersant by 0.1 to 5 ml to 100 to 150 ml of the electrolyte, and the toner of a measurement sample is further added by 2 to 20 mg. The electrolyte having suspended the sample undergoes a dispersion process by an ultrasonic disperser for 1 to 3 minutes, and has particle size distribution of the toner particles of 2 to 40 μm measured by using an aperture of 100 μm with the above Coulter counter TA-II to acquire the volume average particle diameter of the toner therefrom. The average particle diameter of the carrier is indicated by a horizontal maximum length, and a microscope method is used as the measuring method, where over 300 particles are randomly chosen to measure the diameters thereof and acquire an arithmetic average.

[Cleaner]

Next, the cleaner 6 will be further described. The cleaner 6 has a blade-like cleaning member consisting of an elastic body such as polyurethane rubber, that is, a cleaning blade 61. The cleaning blade 61 is normally put in contact with the photosensitive member 1 with an edge portion on a free end side facing the upstream side of the rotation direction of the photosensitive member 1 (counter contact), and is fixed on a waste toner container 62 by a support member 63. Foreign substances such as the transfer-leftover toner scraped off the surface of the photosensitive members 1 are accommodated in the waste toner container 62. It is also possible, by further using carrier means such as a screw and a belt, to collect the waste toner in a collection container separately provided from the waste toner container 62 of the cleaner 6 of one or multiple image forming units.

The cleaner 6 removes the foreign substances such as the transfer-leftover toner from the photosensitive members 1, and, as will be described in detail later, also slides the photosensitive members 1 with the cleaning blade 61 and thereby removes the discharges adherent to the surface of the photosensitive members 1.

This embodiment uses the cleaning blade 61 of 2-mm thickness and 341-mm longitudinal length consisting of polyurethane as the cleaning member. The edge portion on the free end side of the cleaning blade 61 is pressed onto the photosensitive members 1 with contact pressure of 8N so as to form a cleaning portion (cleaning nip) m.

The contact pressure of the cleaning blade 61 against the photosensitive member 1 in the cleaning portion m is measured by mounting a pressure sensor on the photosensitive member 1 and converting the force of the cleaning blade 61 for pressing the photosensitive member 1 to the contact pressure.

[Photosensitive Member]

Next, the photosensitive members 1 will be further described. As for the photosensitive member 1, it is possible to use a normal organic photosensitive member (OPC) or a photosensitive member using an inorganic substance semiconductor such as CdS, Si (amorphous silicon) or Se.

Figure 4:
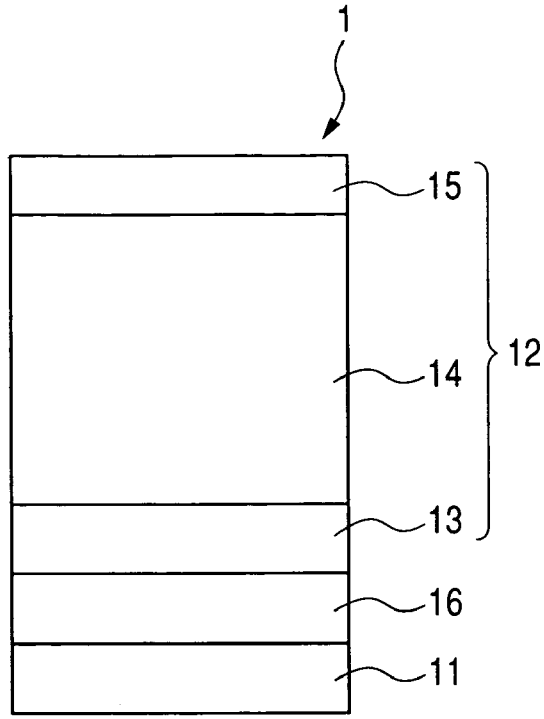
FIG. 4 is a pattern diagram for describing an example of a layer configuration of a photosensitive member.

FIG. 4 schematically shows a layer configuration of a general organic photosensitive member. The photosensitive member 1 has photosensitive layers 12 including a surface protective layer 15 sequentially laminated on a conductive support 11, where an outermost surface of the surface protective layer 15 is a free surface. The photosensitive layers 12 have either a configuration in which a charge transport layer 14 including a charge transport substance is laminated on a charge generation layer 13 including a charge generation substance or a configuration in which the charge generation layer 13 is over the charge transport layer 14 and the surface protective layers 15 is further laminated. It is also possible, other than such layer configurations, to have a configuration having the photosensitive layer 12 of a single layer system in which the charge generation substance and charge transport substance are dispersed in the same layer. In the case of having a laminated structure, there may be multiple charge transport layers 14. The photosensitive member 1 may also have a conductive layer or a rectifying undercoating layer 16 between the conductive support 11 and the photosensitive layers 12. This embodiment uses the photosensitive member 1 of 84-mm outside diameter and 381-mm longitudinal length having the following layer configuration.

Here, an elastic deformation ratio W of the photosensitive member 1 will be described.

The elastic deformation ratio W of the photosensitive member 1 can be measured by using a microhardness measuring apparatus Fischer scope H100V (manufactured by Fischer) capable of acquiring hardness continuously by continuously loading an indenter and directly reading an indentation depth under a load. As for the indenter, it is possible to use a Vickers quadrilateral diamond indenter of an opposite face angle of 136 degrees. To be more precise, measurements should be made stepwise up to a final load of 6 mN (273 points with holding time of 0.1 S for each point) (measuring environment: temperature/humidity=23° C./55%).

Figure 15:
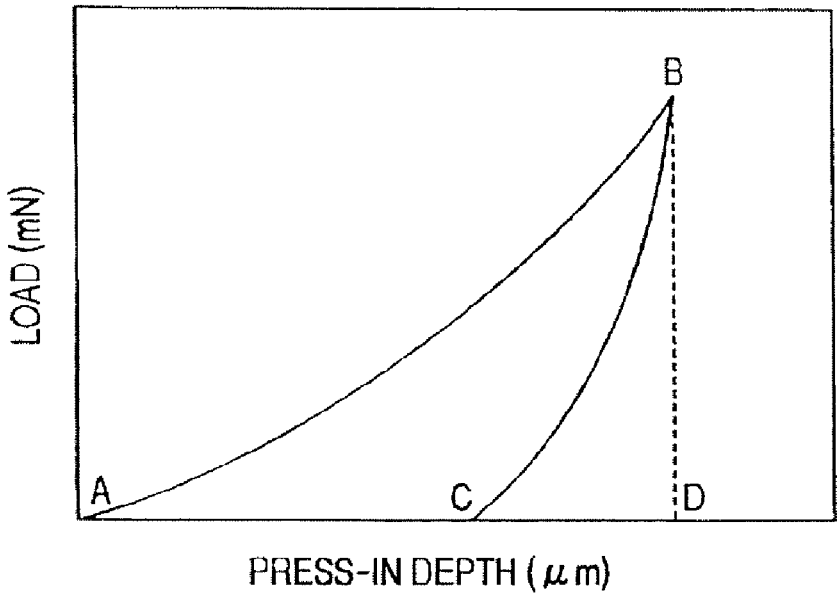
FIG. 15 is a diagram showing an example of an output chart of a measuring apparatus for measuring the elastic deformation ratio.
Figure 16:
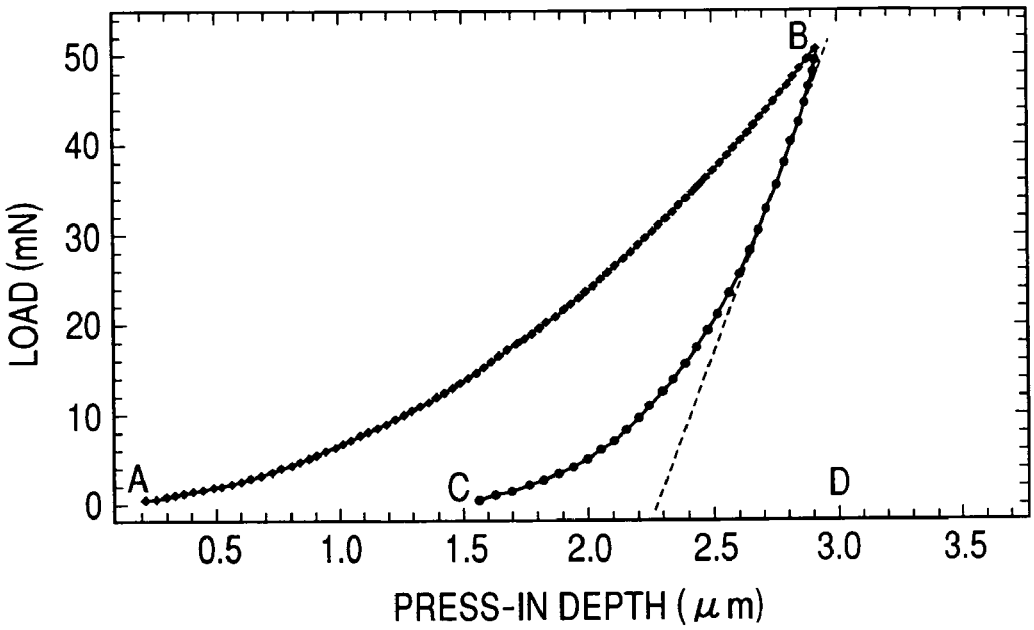
FIG. 16 is a diagram showing an example of the output chart measuring the elastic deformation ratio of the photosensitive member.
Figure 17:
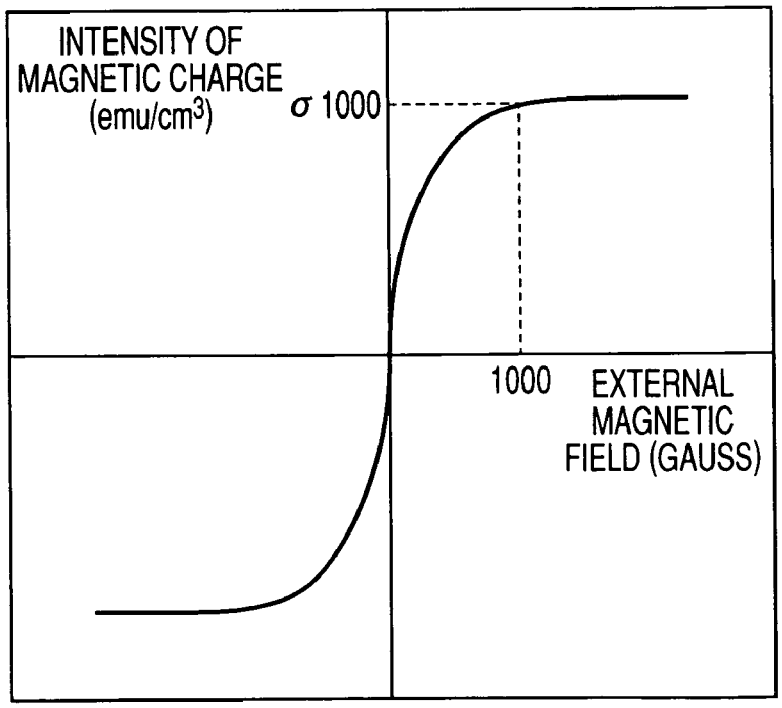
FIG. 17 is a graph chart showing a hysteresis curve of a magnetic carrier.

FIG. 15 shows a simple overview of an output chart of the Fischer scope H100V (manufactured by Fischer). FIG. 16 shows an example of a result of measuring the photosensitive member 1 usable in this embodiment with the Fischer scope H100V (manufactured by Fischer). In the drawings, a vertical axis indicates a load F [mN], and a horizontal axis indicates an indentation depth h [μm]. The drawings show the results of increasing the load stepwise up to 6 mN and decreasing the load stepwise likewise thereafter. The elastic deformation ratio W can be acquired by a workload (energy) performed to a film by the indenter, that is, a change in the energy due to increase and decrease in the indenter's load on the film. To be more precise, it can be acquired by the following formula (1).

$$\text{Elastic deformation ratio } W[\%]=We/Wt\times 100 \quad (1)$$

In the formula, a total workload Wt [nJ] denotes the area surrounded by A, B, D and A in FIG. 15, and an elastic deformation workload We [nJ] denotes the area surrounded by C, B, D and C.

Here, if the elastic deformation ratio W of the photosensitive member 1 is 48 percent or more, its life can be extended by 100 K (100,000) sheets (number of image forming sheets for A4-size recording material (carrier direction length 210 mm): same hereunder) or so as will be described in detail later.

[Removal of Discharges]

Next, a description will be given as to a correlation among the configurations of the photosensitive member, the developing device and the cleaner for removal of the discharges, which is a characteristic of this embodiment.

The image forming apparatus 100 of this embodiment uses the corona discharger (primary charging device) 2 as the charging means for uniformly charging the photosensitive member. In the case of charging performed by such a discharge means, the discharge such as nitrogen oxide (hereafter referred to as "NOx") is generated, which partially adheres to the surface of the photosensitive member. The present invention does not limit the charging method to a corona charging method using the corona discharger. For instance, it is possible to use a roller charging method of charging the photosensitive member 1 by applying a charging bias voltage to a roller member for rotating in contact with the photosensitive member 1.

As previously described, of the discharges adherent to the surface layer of the photosensitive member 1, the NOx remaining on the surface layer of the photosensitive member generates nitric acid by reacting with moisture in the air or generates metal nitrate by reacting with a metal. If the nitric acid or nitrate thus generated is formed as a thin film on the surface of the photosensitive member 1, the resistance value on the surface of the photosensitive member 1 is reduced by moisture absorption of the nitric acid or nitrate. There are the cases where the electrostatic image formed on the photosensitive member 1 is thereby destroyed and the quality of a formed image is lowered. Under a high-humidity environment in particular, there may be a problem that an abnormal image as if the image is deleted (image deletion) is apt to be generated.

Here, in the case of using a conventional general organic photosensitive member (the elastic deformation ratio W is 40 percent or so) as previously described, the surface layer of the photosensitive member 1 is scraped away by an infinitesimal amount by sliding the photosensitive member 1 with the magnetic brush 47 of the developer in the development portion (development nip) n or sliding the photosensitive member 1 with the cleaning blade 61. And the nitric acid or metal nitrate resulting from the above-described discharges are removed on having the surface layer of the photosensitive member 1 scraped away. Thus, it is conventionally possible to suppress generation of the abnormal image due to the Nox to a certain extent.

In the case of using the conventional general organic photosensitive member (the elastic deformation ratio W is 40 percent or so), however, it is possible to scrape away the photosensitive member 1 by 2.3 μm per 10 K (10000) sheets (2.3 μm/10K) or so during intermittent endurance. Here, the scraped-away amount of the photosensitive member 1 is not completely even in the plane under ordinary circumstances. For this reason, in the case of aiming at long-term durability exceeding 100K sheets, there may be a problem that a partially scraped-away portion of the photosensitive member 1 becomes a scratch which affects the image. There may also be a problem that, as a film thickness of the photosensitive member 1 is reduced, a capacitance of the photosensitive member 1 changes and an image gradation property (Y) becomes higher so that it becomes difficult to control gradation.

For that reason, it is desirable to use a hardened photosensitive member, that is, the photosensitive member 1 of which elastic deformation ratio W is 48 percent or more in further detail. Under ordinary circumstances, the elastic deformation ratio W of the photosensitive member manufactured by a general method is up to 75 percent at the highest. To be more specific, it is desirable to use the photosensitive member of which elastic deformation ratio W is 48 to 75 percent.

The elastic deformation ratio W is roughly controllable by the material. Normally, it is 35 to 41 percent or so for an ordinary organic photosensitive member, 45 to 55 percent or so for an organic photosensitive member more hardened by having the surface protective layer, and 70 percent or more in the case of using Si (such as amorphous silicon).

Figure 5:
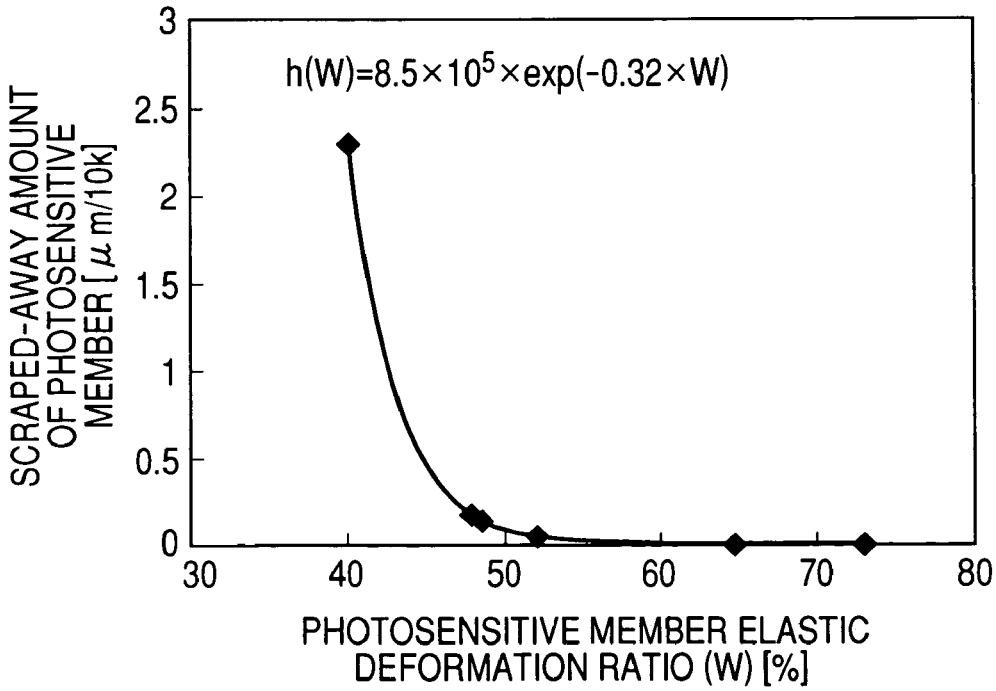
FIG. 5 is a graph chart showing a relation between an elastic deformation ratio W and a scraped-away amount of the photosensitive member.

FIG. 5 shows a relation between the elastic deformation ratio W of the photosensitive member 1 and the scraped-away amount thereof. It is understandable from FIG. 5 that the higher the elastic deformation ratio W is, the more difficult it becomes to scrape away the surface layer of the photosensitive member 1. As a whole, it indicates that the smaller a deformation amount against an external stress becomes, the higher the hardness of the surface layer of the photosensitive member 1 is.

As previously described, however, it may be difficult, in the case of reducing the scraped-away amount of the surface layer of the photosensitive member 1, to scrape away the film of the nitric acid or nitrate formed on the photosensitive member 1 by the conventional method.

Thus, the inventors hereof came to have a viewpoint that, in the case of using the photosensitive member 1 having its surface layer hardened and having difficulty in removing the discharges, it may be possible to increase a sliding force of the magnetic brush 47 in the development portion n or the cleaning blade 61 against the photosensitive member 1 so as to remove only the discharges.

However, in the case of using the cleaning blade 61 consisting of an elastic body such as polyurethane rubber, for instance, in the state where absorptiveness on the surface of the photosensitive member 1 is increased by the discharges, it also increases the absorptiveness of the cleaning blade 61 to the photosensitive member 1 so that a sliding torque between the cleaning blade 61 and the photosensitive member 1 increases. Consequently, there may be a problem of reduction in the life of the cleaning blade 61 due to a crack thereof. The removal of the discharges by increasing the sliding force of the cleaning blade 61 is apt to lead to further cracks of the cleaning blade 61.

In consideration of the above-mentioned situation, the inventors hereof found out as a result of keen examination that there is a suitable method of increasing the sliding force of the magnetic brush 47 in the development portion n as another main portion for sliding the photosensitive member 1 while maintaining a conventional cleaner setup. If a sliding level of the magnetic brush 47 in the development portion n is simply increased, however, there is a possibility that the photosensitive member 1 may have a scratch due to an excessively high sliding level. To be more specific, pressure distribution of the developer on the developing sleeve 42, that is, the magnetic brush 47 on the photosensitive member 1 is not completely even in the entire area of the development portion n. For this reason, there is a possibility that an ultrahigh pressure portion may be generated in an infinitesimal range so that the photosensitive member 1 may have a scratch.

Thus, the inventors hereof examine the correlation between the following as to the removal of the discharges adherent to the photosensitive member 1.

(i) Sliding level on the photosensitive member 1

(ii) Hardening level of the photosensitive member 1 Consequently, they found a proper area of the (i) sliding level on the photosensitive member 1 and (ii) hardening level of the photosensitive member 1 capable of limiting the scraped-away amount of the photosensitive member 1 to earn the life of the photosensitive member and removing the discharges adherent to the photosensitive member 1 with no scratch on the photosensitive member so as to complete the present invention.

Hereunder, a detailed description will be given as to a method of deriving a proper range of the above items (i) and (ii).

The inventors hereof variously examined the elastic deformation ratio W of the photosensitive member 1, the contact pressure of the magnetic brush 47 against the photosensitive member 1 relating to the sliding level of the development portion n, that is, the contact pressure of the magnetic brush 47 against the photosensitive member 1 during rest (hereafter, magnetic brush pressure) in further detail, a circumferential velocity (surface migration speed) of the photosensitive member 1, the circumferential velocity (surface migration speed) of the developing sleeve 42 and so on, and consequently found out that the proper area of the (i) sliding level on the photosensitive member 1 and (ii) hardening level of the photosensitive member 1 are determined by performing the following.

(I) Setting an index S as a degree of the removal of the discharges on the photosensitive member 1 in the development portion n by means of sliding (hereafter, referred to as a "sliding degree" without a unit).

(II) Determining a minimum value of the above S capable of avoiding the crack of the cleaning blade 61 or the image deletion from a photosensitive member surface recovery function I ($Dr_{Recovery}$).

(III) Determining a maximum value of the above S for generating no scratch appearing on the image from a scratch function J ($Dr_{scrape}$) of the photosensitive member 1.

[I. Sliding Degree S of the Photosensitive Member 1 in the Development Portion n]

First, a detailed description will be given as to the sliding degree S of the photosensitive member 1 in the development portion n. The sliding degree S is defined by the following formula.

$$S = P\times\left\{\frac{|v_{S1}-v_{Dr}|}{v_{Dr}}\right\}\times\{8.50\times10^5\times\exp(-0.32W)\}.$$

P: Magnetic brush pressure [Pa]

$v_{S1}$: Developing sleeve circumferential velocity [mm/s]

$V_{Dr}$: Photosensitive member circumferential velocity [mm/s]

W: Photosensitive member elastic deformation ratio [%]

To be more specific, the sliding degree S represented by the formula (2) signifies removability of the discharges from the surface of the photosensitive member 1 or a degree of generation of the scratches on the photosensitive member 1 due to the sliding of the photosensitive member 1 with the magnetic brush 47 in the development portion n. And the formula (2) indicates that the sliding degree S is determined by the magnetic brush pressure, the circumferential velocity of the photosensitive member 1 and the elastic deformation ratio W of the photosensitive member 1. To describe it in greater detail, the first term (f (magnetic brush pressure)=P), the second term (g (photosensitive member circumferential velocity)=($|V_{SI}-V_{Dr}|$)/$V_{Dr}$) and the third term (h (photosensitive member elastic deformation ratio)=$8.50\times10^5\times\exp(-0.32\ W)$) in the formula (2) signify the following respectively.

First term: As the contact pressure (magnetic brush pressure) of the magnetic brush 47 against the photosensitive member 1 during rest becomes higher, the sliding degree S increases.

Numerator of the second term: As a circumferential velocity difference (surface migration speed difference) between the developing sleeve 42 and the photosensitive member 1 becomes larger, the sliding degree S increases.

Denominator of the second term: As the photosensitive member circumferential velocity becomes higher, the sliding degree S decreases. This is because the area of the surface of the photosensitive member 1 to be passed per unit time becomes larger. To be more specific, in the case where a certain sliding force is applied, the area to be passed becoming larger signifies that the degree of pressure exerted per unit area is reduced. As the number of rotations of the photosensitive member 1 increases, it is thinkable that the pressure exerted per unit area per unit time becomes constant. However, adherence of the discharges due to charging occurs at each rotation in reality and so the above formula is correct.

Third term: It is the function obtained from experimental data shown in FIG. 5. It is a tendency that, as the elastic deformation ratio W of the photosensitive member 1 becomes smaller, S increases more drastically. FIG. 5 shows the result of examination in the state where the elastic deformation ratio W is varied in the state of being fixed at f (magnetic brush pressure)≦200 Pa, g (photosensitive member circumferential velocity)≦0.7 mm/s.

Figure 6:
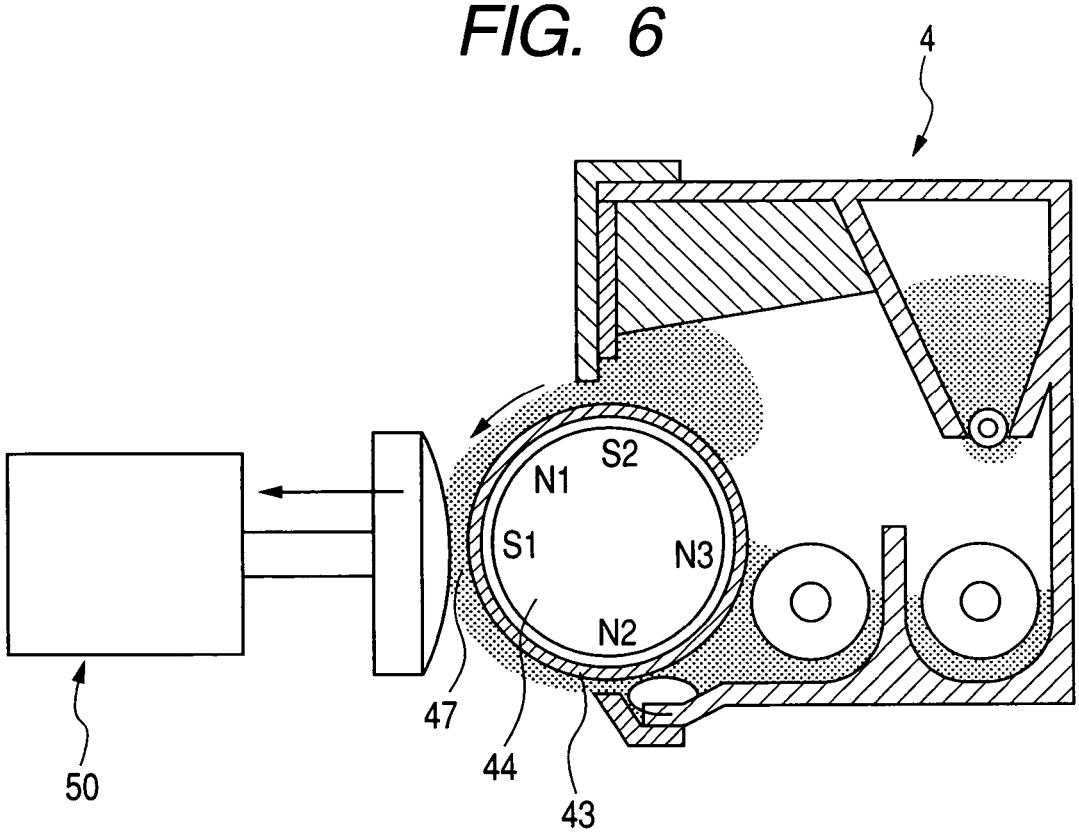
FIG. 6 is a pattern diagram for describing a method of measuring a magnetic brush pressure of a magnetic brush.

Here, the contact pressure (magnetic brush pressure) of the magnetic brush 47 against the photosensitive member 1 during rest of the first term in the formula (2) is measured as shown in FIG. 6. A pressure sensor (Kyowa Electronic Instruments LMA-A-5 to 50N having a contact portion fitting the diameter of the photosensitive member (photoconductive drum) 1 combined therewith) 50 is placed opposite the developing sleeve 42 so as to selectively measure the pressure in the arrow direction (equivalent to a normal direction of the developing sleeve 42 at the most adjacent position of the developing sleeve 42 and the photosensitive member 1). Contact area of the magnetic brush of the magnetic carrier against the photosensitive member 1 is measured, and the pressure is indicated as plane pressure per unit area [Pa]. As for the contact area of the magnetic brush 47 on the photosensitive member 1, a developer contact trace remaining on the contact portion (the toner adheres around the contact portion, and the contact portion itself has the toner scraped away by the carrier) is taped with transparent tape and is affixed on paper to have the area measured.

Furthermore, the relation between the magnetic brush pressure of the first term in the formula (2) and conditions of a general developing device 4, that is, $G_{SD}$, M, B, C and H has been clarified. The following formula shows this.

$$f(\text{Magnetic brush pressure})=\{fa(G_{SD})\times fb(M)\times fc(B)\times fc(C)\times fe(H)\times\alpha\}$$

fa ($G_{SD}$)=$1.078315\times10^3\times\exp(-3.50\times10^{-3}\times G_{SD})$ fb (M)=$1.1768499\times10^{-6}\times M$ fc (B)=$1.8730701\times10^2\times B$ fd (C)=$6.246836\times10^{-1}\times C$ fe (H)=$4.1580196\times H$ $\alpha=8.17774\times10^{-10}$ $G_{SD}$: Gap between the developing sleeve and the photosensitive member [μm]

M: Magnetic amount of the carrier on applying a magnetic field of 100 mT [A/m]

B: Magnetic flux density of the magnetic pole opposed to the photosensitive member provided to the magnet roller [mT]

C: Developer amount per unit area on the developing sleeve [mg/cm$^2$]

H: an angle of a half-value width of a magnetic flux density of the magnetic pole opposed to the photosensitive member provided to the magnet roller [°(deg.)]

Here, the unit is pressure [Pa] as to fa ($G_{SD}$), fb (M), fc (B), fd (C) and fe (H) which are the functions derived from an approximation formula by examining the relation between various development conditions and the magnetic brush pressure. It is possible to derive the pressure [Pa] in an actual system by multiplying a product of each term by a conversion coefficient α[1/Pa$^4$]. The conversion coefficient α can be acquired by I) measuring "actual magnetic brush pressure" under a certain condition and II) dividing the condition by the product applied to fa ($G_{SD}$), fb (M), fc (B), fd (C) and fe (H) (I/II). Here, the conversion coefficient $\alpha=8.17774\times10^{-10}$ [1/Pa$^4$].

Here, the gap $G_{SD}$ [mm] between the developing sleeve 42 and the photosensitive member 1 is a vertical distance between the surface of the developing sleeve 42 and the surface of the photosensitive member 1 at the most adjacent position.

To measure the magnetic amount of the carrier M [A/m] on applying the magnetic field of 100 mT, a DC magnetization B-H characteristic recording apparatus BHH-50 of Riken Denshi, Co., Ltd. was used. The graph shown in FIG.

17 is an example showing a measurement result of a magnetic characteristic obtained by the apparatus, where the magnetic amount of the carrier at an external magnetic field 100 mT (1000 G) is the M [A/m] sought.

As for the magnetic amount of the carrier M [A/m] on applying the magnetic field of 100 mT, 1.2 to $2.3\times10^8$ [A/m] is normally used, which value mainly depends on the material to be used. A ferrite 1.5 carrier widely used in general is in the neighborhood of $2.25\times10^8$ [A/m].

The magnetic pole opposed to the photosensitive member 1 is the one having a peak position of a magnetic force thereby generated in the normal direction of the developing sleeve 42 is in the development portion n. The peak position of the magnetic force does not have to match with the position of the magnetic pole in the circumferential direction of the developing sleeve 42.

The magnetic flux density B [mT] of the magnetic pole opposed to the photosensitive member 1 is the magnetic flux density at the most adjacent position to the photosensitive member 1 on the developing sleeve 42 measured by using "MS-9902" (product name) manufactured by F. W. BELL as a measuring instrument while setting the distance between a probe as a member of the measuring instrument and the surface of the developing sleeve 42 at approximately 100 μm.

If the value of the magnetic flux density of the magnetic pole opposed to the photosensitive member 1 is too weak, the force for holding the carrier in the development portion n is weak, and so there occurs a phenomenon that the carrier adheres to the photosensitive member 1 along with an electric field on development. The carrier adherent to the photosensitive member 1 is not so desirable because it may scratch or crack the photosensitive member 1 or the cleaning blade 61 on coming to the cleaning portion for instance. If the value of the magnetic flux density of the magnetic pole opposed to the photosensitive member 1 is too strong, the magnetic brush of the carrier in the development portion n becomes short so that developability becomes weak. It is not desirable to increase a development bias electric field to make up for it because a discharge phenomenon (leak) occurs in the development portion n. For these reasons, the magnetic flux density of the magnetic pole opposed to the photosensitive member is normally 70 to 150 mT, and around 100 mT is most frequently used.

The developer amount C per unit area on the developing sleeve 42 [mg/cm$^2$] is calculated by preparing a mask member of certain area, pressing the mask member against the developing sleeve 42, peeling the developer in the mask area off the developing sleeve 42 with a magnet, measuring weight of the peeled developer and dividing it by the mask area.

If the developer amount C per unit area on the developing sleeve 42 [mg/cm$^2$] is small, the developability is reduced. And if the development bias electric field is increased to make up for it, the discharge phenomenon (leak) occurs in the development portion n, which is not desirable. If too large, it is not desirable because there are possibilities that the gap $G_{SD}$ between the developing sleeve 42 and the photosensitive member 1 may be clogged with the developer or the toner may splash. Therefore, the developer amount C per unit area on the developing sleeve 42 is normally 10 to 50 [mg/cm$^2$], and around 30 [mg/cm$^2$] is most frequently used. The angle of a half-value width of a magnetic flux density of the magnetic pole opposed to the photosensitive member 1 H [°(deg.)] was measured by using a magnetic field measuring instrument "MS-9902" (product name) manufactured by F. W. BELL as a measuring instrument while setting the distance between the probe as a member of the measuring instrument and the surface of the developing sleeve 42 at approximately 100 μm.

If the angle of a half-value width of a magnetic flux density H of the magnetic pole opposed to the photosensitive member 1 [°(deg.)] is wide, the developability increases. If narrow, the image is less influenced by the magnetic brush of the developer (unevenness appearing on the image due to the magnetic brush decreases). While an angle of a half-value width of a magnetic flux density H of the magnetic pole opposed to the photosensitive member 1 is determined by a magnet material to be used and a placement pattern of the poles of the magnet, it is normally used in the range of 20 to 60 degrees. It is normally around 40 degrees.

Hereunder, the methods of deriving the functions fa ($G_{SD}$), fb (M), fc (B), fd (C) and fe (H) will be described respectively.

1. Function fa ($G_{SD}$)

$$fa(G_{SD})=1.078315\times10^3\times\exp(-3.50\times10^{-3}\times G_{SD})$$

Figure 7:
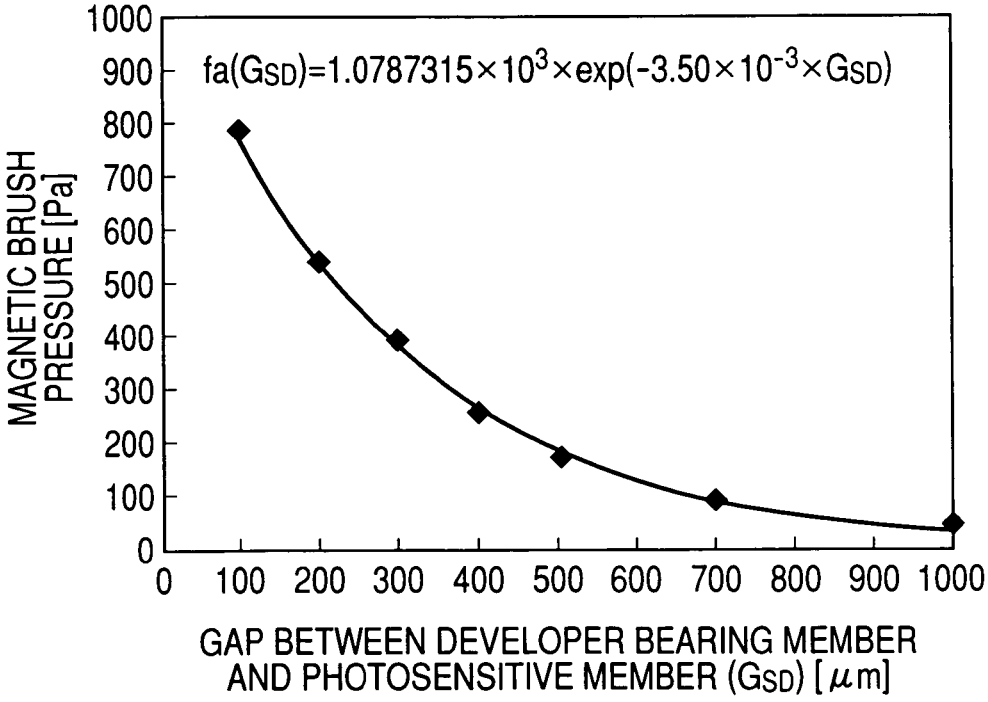
FIG. 7 is a graph chart showing a relation between a gap $G_{SD}$ between a developing sleeve and the photosensitive member and the magnetic brush pressure.

FIG. 7 shows the relation between the magnetic brush pressure [Pa] and the gap $G_{SD}$ between the developing sleeve 42 and the photosensitive member 1 [μm] at $M=1.59\times10^8$ A/m (=200 emu/cm$^3$), B=100 mT, C=30 mg/cm$^2$ and H=40°. The function fa ($G_{SD}$) represented by the formula was acquired from the experimental data of FIG. 7. As is understandable from FIG. 7, the magnetic brush pressure tends to increase drastically as the gap $G_{SD}$ between the developing sleeve 42 and the photosensitive member 1 becomes narrower.

2. Function fb (M)

$$fb(M)=1.1768499\times10^{-6}\times M$$

Figure 8:
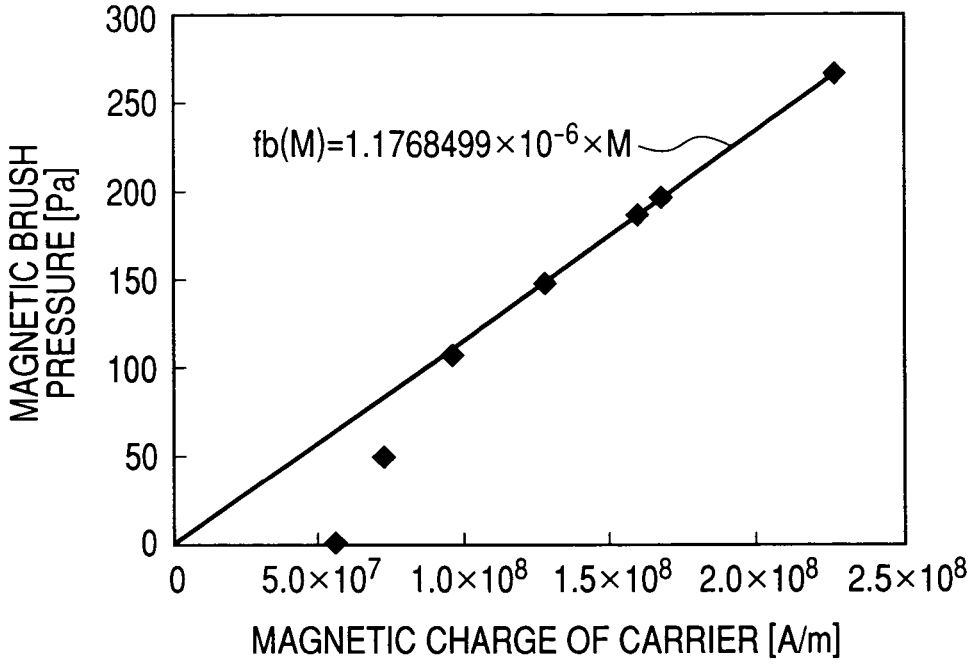
FIG. 8 is a graph chart showing a relation between a carrier magnetic amount M and the magnetic brush pressure.

FIG. 8 shows the relation between the magnetic brush pressure [Pa] and a carrier magnetic amount M (on applying a magnetic field of 100 mT) [A/m] at $G_{SD}$=500 μm, B=100 mT, C=30 mg/cm$^2$ and H=40°. The function fb (M) represented by the formula was acquired from the experimental data shown in FIG. 8.

As is understandable from FIG. 8, the magnetic brush pressure tends to monotonically increase as the carrier magnetic amount (on applying a magnetic field of 100 mT) M becomes larger. If the carrier magnetic amount (on applying a magnetic field of 100 mT) M is smaller than $9.55\times10^7$ A/m (=120 emu/cm$^3$), however, this formula is no longer applicable, and the magnetic brush pressure becomes approximately 0 when M is $5.57\times10^7$ A/m (=70 emu/cm$^3$). This means that the magnetic brush 47 is not well formed if the carrier magnetic amount is extremely reduced, and the magnetic brush 47 has not reached the photosensitive member 1 if the carrier magnetic amount (on applying a magnetic field of 100 mT) M is smaller than $5.57\times10^7$ A/m (=70 emu/cm$^3$).

Therefore, it is desirable that the carrier magnetic amount (on applying a magnetic field of 100 mT) M [A/m] is $9.55\times10^7$ A/m (=120 emu/cm$^3$) or more ($M=9.55\times10^7$ A/m).

3. Function fc (B)

$$fc(B)=1.8730701\times10^{-2}\times B$$

Figure 9:
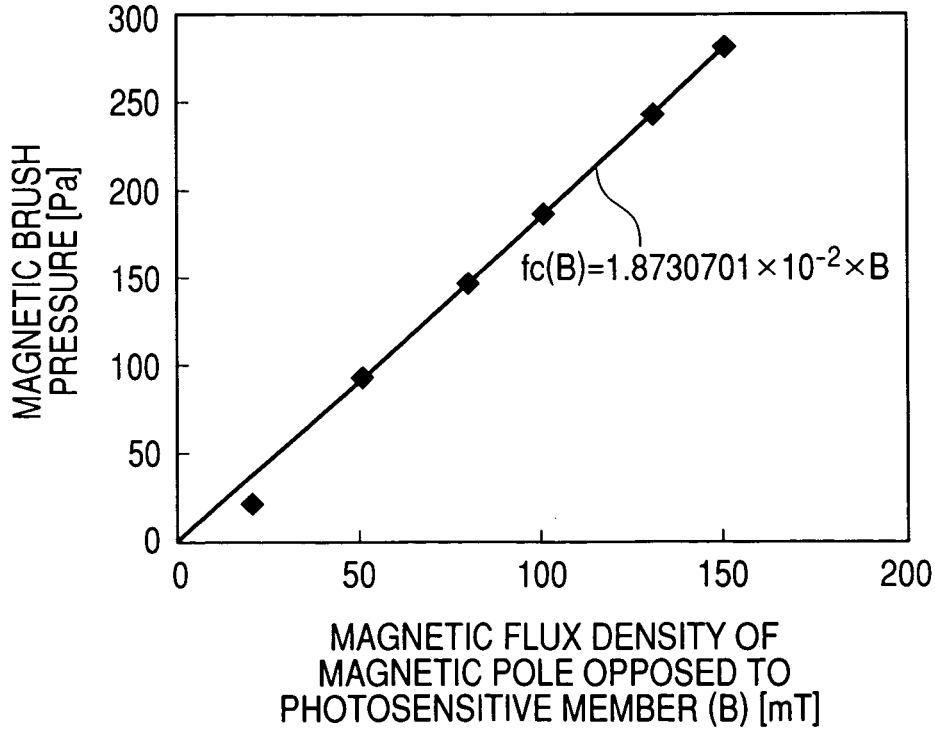
FIG. 9 is a graph chart showing a relation between a magnetic flux density B of a magnetic pole opposed to the photosensitive member and the magnetic brush pressure.

FIG. 9 shows the relation between the magnetic brush pressure [Pa] and a magnetic flux density B of the magnetic pole opposed to the photosensitive member 1 [mT] at $G_{SD}$=500 μm, $M=1.59\times10^8$ A/m (=200 emu/cm$^3$), C=30 mg/cm$^2$ and H=40°. The function fc (B) represented by the formula was acquired from the experimental data shown in FIG. 9. As is understandable from FIG. 9, the magnetic brush pressure tends to monotonically increase as the magnetic flux density B of the magnetic pole opposed to the photosensitive member 1 becomes larger. If the magnetic flux density B of the magnetic pole opposed to the photosensitive member 1 is 50 mT or less, however, this formula is no longer applicable.

This means that the magnetic brush 47 is not well formed if the magnetic flux density of the magnetic pole opposed to the photosensitive member 1 is 50 mT or less.

Therefore, it is desirable that the magnetic flux density B of the magnetic pole opposed to the photosensitive member 1 [mT] is larger than 50 mT (B>50 mT).

4. Function fd (C)

$$fd(C)=6.246836\times10^{-1}\times C$$

Figure 10:
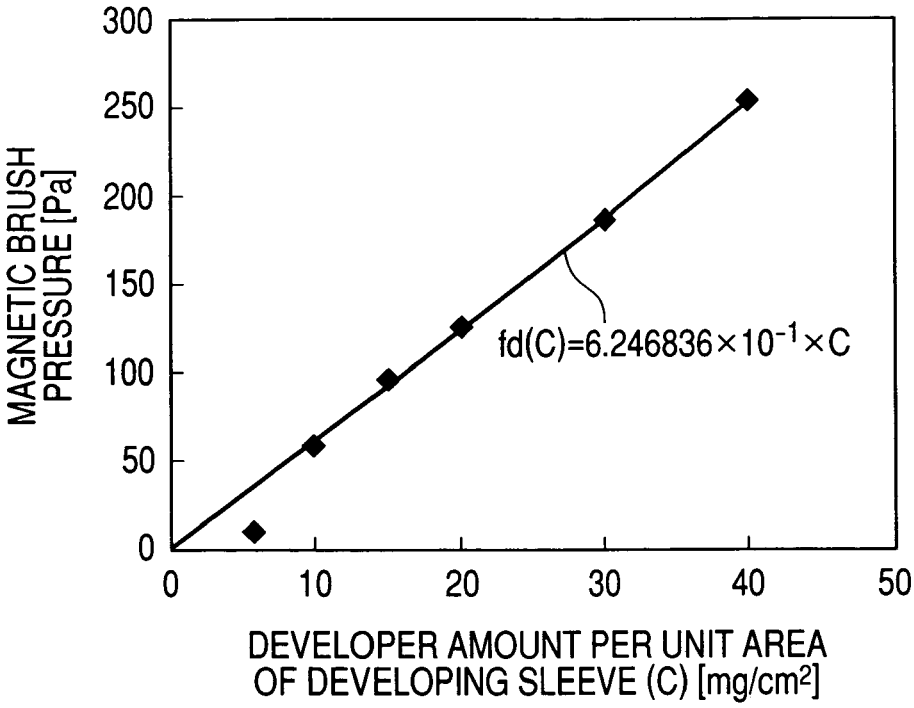
FIG. 10 is a graph chart showing a relation between a developer amount C per unit area on the developing sleeve and the magnetic brush pressure.

FIG. 10 shows the relation between the magnetic brush pressure [Pa] and a developer amount C per unit area on the developing sleeve 42 [mg/cm$^2$] at $G_{SD}$=500 μm, M=1.59×10$^8$ A/m (=200 emu/cm$^3$), B=100 mT and H=40°. The function fd (C) represented by the formula was acquired from the experimental data shown in FIG. 10.

As is understandable from FIG. 10, the magnetic brush pressure tends to monotonically increase as the developer amount C per unit area on the developing sleeve 42 becomes larger. If the developer amount C per unit area on the developing sleeve 42 is smaller than 10 mg/cm$^2$, however, this formula is no longer applicable.

This means that the developer is not evenly coated on the developing sleeve 42 and a correct measurement is not made if the developer amount C per unit area on the developing sleeve 42 [mg/cm$^2$] is smaller than 10 mg/cm$^2$.

Therefore, it is desirable that the developer amount C per unit area on the developing sleeve 42 [mg/cm$^2$] is 10 mg/cm$^2$ or more (C≧10 mg/cm$^2$).

5. Function fe (H)

$$fe(H)=4.1580196\times H$$

Figure 11:
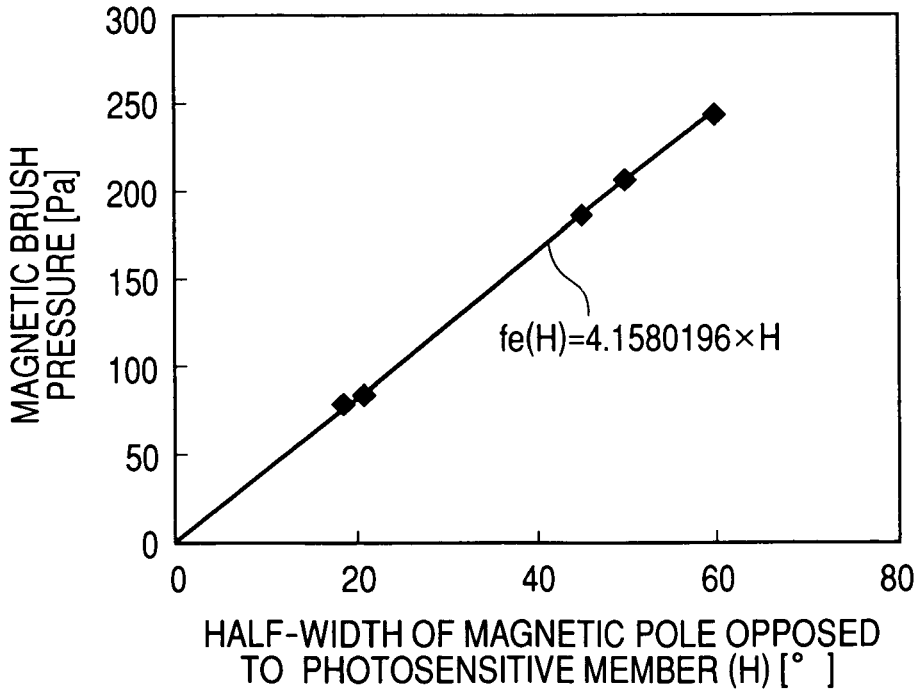
FIG. 11 is a graph chart showing a relation between an angle of a half-value width of a magnetic flux density H of the magnetic pole opposed to the photosensitive member and the magnetic brush pressure.

The formula shows the relation between the magnetic brush pressure [Pa] and an angle of a half-value width of a magnetic flux density of the magnetic pole opposed to the photosensitive member 1 H [°] at $G_{SD}$=500 μm, M=1.59×10$^8$ A/m (=200 emu/cm$^3$), B=100 mT and C=30 mg/cm$^2$, which was acquired from the experimental data shown in FIG. 11.

As is understandable from FIG. 11, the magnetic brush pressure tends to monotonically increase as the an angle of a half-value width of a magnetic flux density H of the magnetic pole opposed to the photosensitive member 1 becomes larger.

[II. Photosensitive Member Surface Recovery Function I ($Dr_{Recovery}$)]

Next, a detailed description will be given as to the photosensitive member surface recovery function I ($Dr_{Recovery}$) and a method of determining from this function a minimum value of a degree of sliding S capable of avoiding reduction in the life due to the crack of the cleaning blade 61.

The photosensitive member surface recovery function I ($Dr_{Recovery}$) is defined by the following formula.

$$I(Dr\ \text{recovery}) = -\frac{A}{X+\frac{A}{80}}+90 \tag{3}$$

$$I(Dr\ \text{recovery})\text{: Water contact angle[°]}$$

$$A=\frac{1}{\beta S}$$

β: Sliding—Recovery correction coefficient

X: Number of rotations of the photosensitive member

The value of the photosensitive member surface recovery function I ($Dr_{Recovery}$) itself is the water contact angle [°(deg.)]. The photosensitive member surface recovery function I ($Dr_{Recovery}$) is an index for indicating the discharge amount adherent to the surface of the photosensitive member 1. To be more specific, the photosensitive member surface recovery function I ($Dr_{Recovery}$) is a parameter related to hydrophilicity of the surface of the photosensitive member 1 and correlating with causability of the image deletion.

Figure 12A:
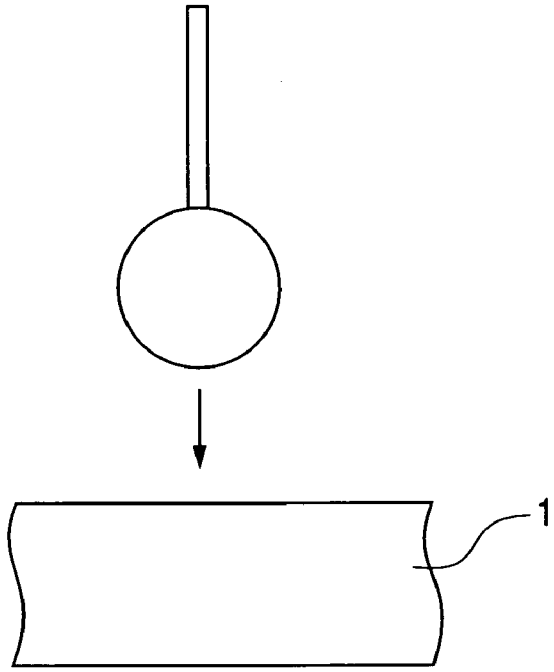
FIGS. 12A, 12B and 12C are pattern diagrams for describing measurement of a contact angle of water as an index of a degree of recovery (degree of removal of discharges) of a surface state of the photosensitive member.

Here, as shown in FIG. 12A, the water contact angle is measured by a water contact angle θ (angle made by a liquid level and the surface of the photosensitive member 1) on the surface layer of the photosensitive member 1 on putting a certain amount of a water droplet 10 on the photosensitive member 1. As for a contact angle gauge, an FASE automatic contact angle gauge CA-X model (manufactured by Kyowa Interface Science, Co., Ltd.) was used. The amount of water delivered by a drop on the surface of the photosensitive member 1 is per instruction of the manufacturer of the gauge.

Figure 12B:
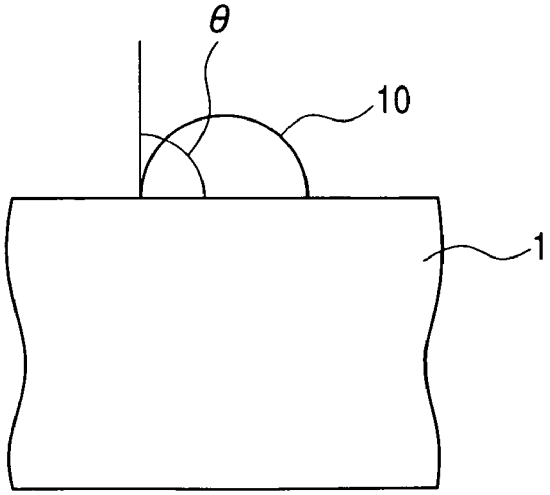
Figure 12C:
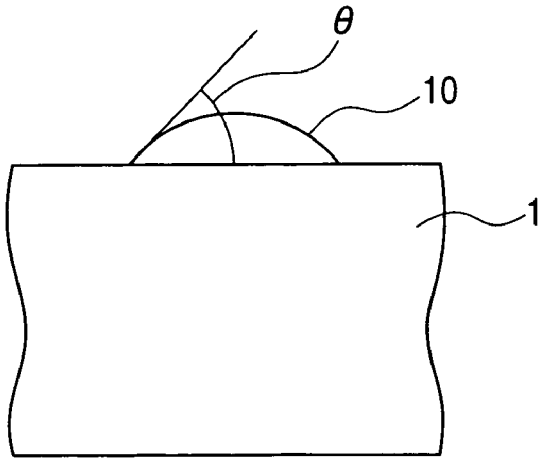

As the absorptiveness of the photosensitive member 1 increases, a tension increases on the interface between the water droplet 10 delivered on the photosensitive member 1 and the surface layer of the photosensitive member 1. In the case where the absorptiveness is low as shown in FIG. 12B, the water droplet 10 becomes almost globular and so the water contact angle becomes larger as shown therein. In the case where the absorptiveness is high as shown in FIG. 12C, the water droplet 10 cannot exist in a globular form and so it expands and the water contact angle becomes smaller.

Figure 13:
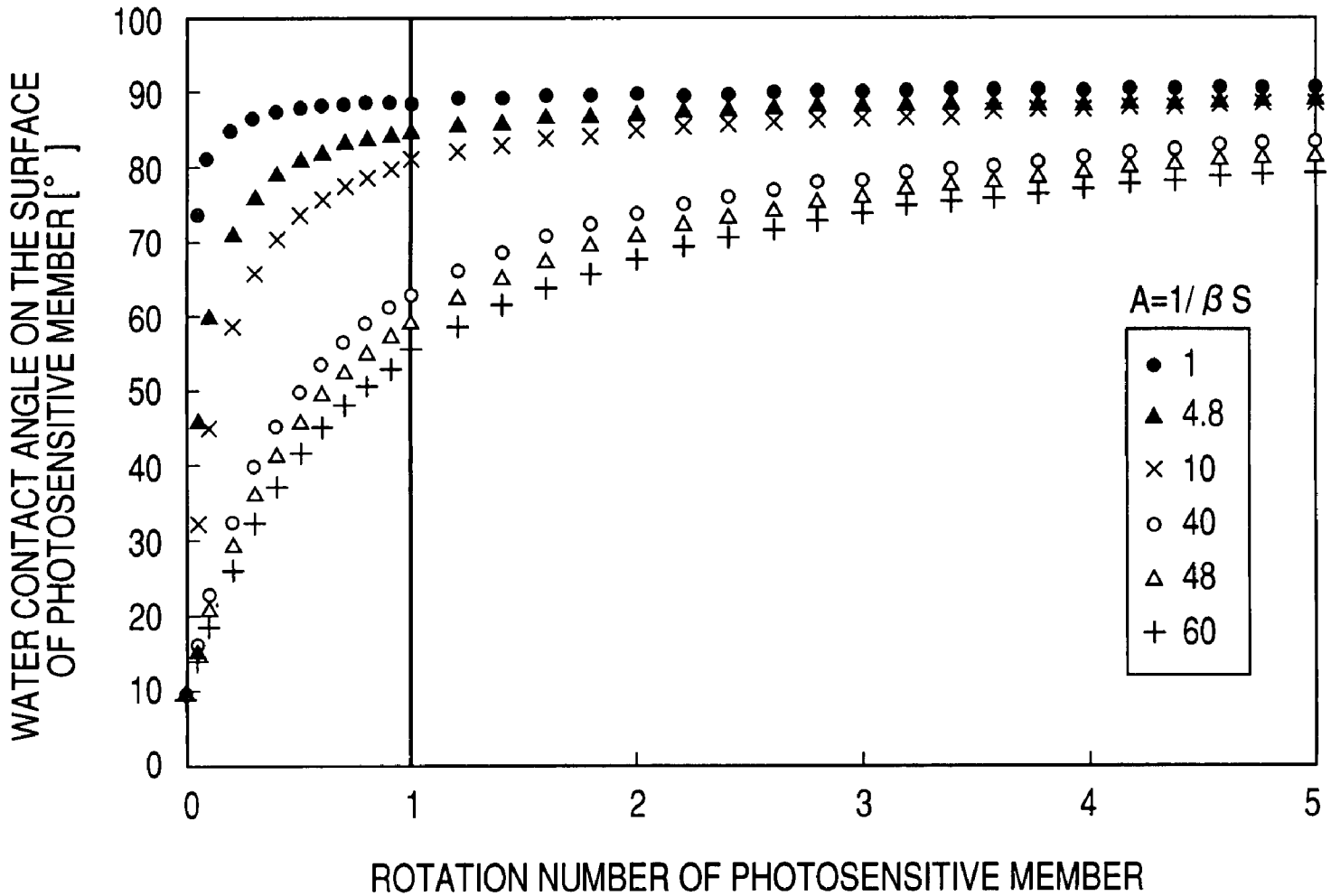
FIG. 13 is a graph chart showing a relation between the number of rotations of the photosensitive member and the contact angle of water.

FIG. 13 shows plotting of a relation between the water contact angle on the surface of the photosensitive member 1 and the number of rotations of the photosensitive member 1 on changing the level of A (=1/βS) in the photosensitive member surface recovery function I ($Dr_{Recovery}$). As for the result in FIG. 13, the rotations were started in the state of having the adherent amount of the discharges on the photosensitive member 1 saturated, and the water contact angle was measured at a fixed point on the photosensitive member 1. Here, the number of rotations 1 of the photosensitive member 1 is equivalent to the number of times by which a certain point on the photosensitive member 1 passes a predetermined sliding portion for the photosensitive member 1.

As is understandable from the graph shown in FIG. 13, the photosensitive member surface recovery function I ($Dr_{Recovery}$) is a curve of which ordinate intercept is 10 degrees and asymptote is 90 degrees. To be more specific, the photosensitive member surface recovery function I ($Dr_{Recovery}$) is a function representing that the water contact angle is approximately 10 degrees in the state of having the discharges to the full on the surface of the photosensitive member 1 (the adherent amount of the discharges has a saturation point) and the water contact angle is approximately 90 degrees in the state of having the discharges completely removed from the surface of the photosensitive member 1.

Here, attention is paid to the I ($Dr_{Recovery}$) when the number of rotations of the photosensitive member 1 is 1 rotation (X=1). Here, it especially means how much a surface state of the photosensitive member 1 recovers, that is, what amount of the discharges are removed after being slid once by the magnetic brush 47 in the development portion n, from the state of having the adherent discharges to the full (saturated state).

The multiple curves shown in FIG. 13 are the ones having the level of A (=1/(βS)) varied, where, as A becomes smaller (that is, as S becomes larger), the value of I (Dr Recovery) becomes larger (that is, the degree of recovery of the surface state of the photosensitive member 1 increases) when X=1.

In the case where the photosensitive member 1 has two sliding portions of the development portion n and cleaning portion m as in the case of this embodiment, there is a problem as to how to share the degree of recovery of the surface state of the photosensitive member 1 in the two sliding portions between the development portion n and the cleaning portion m. As previously described, there may be the problem of reduction in the life of the cleaning blade 61 due to the crack thereof in the state of having the absorptiveness of the surface of the photosensitive member 1 increased by the discharges. There is also a possibility that increasing the degree of sliding on the photosensitive member 1 by the cleaning portion m may facilitate occurrence of the problem of the crack of the cleaning blade 61.

As for the degree of recovery of the surface state of the photosensitive member 1 after being slid once by the magnetic brush 47 in the development portion n from the state of having the adherent amount of the discharge saturated, five water contact angles incremented by 5 degrees between 50 and 70 degrees were prepared so as to examine the levels at which no problem of reduction in the life of the cleaning blade 61 occurs in the cleaning portion m. Tables 1 and 2 show the results.

In tables 1 and 2, a contact pressure level "small" of the cleaning blade 61 against the photosensitive member 1 represents the range of 5N to 7N of the contact pressure measured as above, "medium" represents the range of 7.1N to 9N, and "large" represents the range of 9.1N to 11N. The crack of the cleaning blade 61 was evaluated by performing an endurance test of 10 K sheets and counting blade crack occurrence portions by microscopic observation. "GOOD" indicates the case where the number of cracks is 0, and "NG" indicates the case where the crack has occurred even at one location and caused a phenomenon of the toner slipping through.

TABLE 1

| | | Water contact angle on the photosensitive member surface (photosensitive member elastic deformation ratio: 48%) | | | | |
|---|---|---|---|---|---|---|
| | | 50° | 55° | 60° | 65° | 70° |
| Contact pressure of the cleaning blade | Small | NG | NG | GOOD | GOOD | GOOD |
| | Medium | NG | NG | GOOD | GOOD | GOOD |
| | Large | NG | NG | GOOD | GOOD | GOOD |

TABLE 2

| | | Water contact angle on the photosensitive member surface (photosensitive member elastic deformation ratio: 73%) | | | | |
|---|---|---|---|---|---|---|
| | | 50° | 55° | 60° | 65° | 70° |
| Contact pressure of the cleaning blade | Small | NG | NG | GOOD | GOOD | GOOD |
| | Medium | NG | NG | GOOD | GOOD | GOOD |
| | Large | NG | NG | GOOD | GOOD | GOOD |

The results in tables 1 and 2 were obtained by using relatively hard photosensitive members 1 of which elastic deformation ratios are 48 percent and 73 percent. Extended life of 100K sheets or so can be expected as to such hard photosensitive members 1. For instance, as to the photosensitive member 1 of which elastic deformation ratio W is 48 percent, the contact pressure level of the cleaning blade 61 is "medium" and the scraped-away amount per 10K sheets is approximately 0.18 μm under the development conditions of "example 2" in tables 3, 4 and 5 described later. As for the photosensitive member 1 of which and elastic deformation ratio W is 73 percent, the scraped-away amount thereof per 10K sheets is approximately 0 μm.

If the degree of recovery of the surface state of the photosensitive member 1 after being slid by the magnetic brush 47 in the development portion n is 60 degrees or less as the water contact angle in the case of using such hardly scrapable photosensitive member 1, the absorptiveness on the surface of the photosensitive member 1 is excessively high and so the absorptiveness of the cleaning blade 61 consisting of the elastic body such as polyurethane rubber to the photosensitive member 1 is also high. For this reason, the sliding torque on the surface of the photosensitive member 1 increases and the cleaning blade 61 is apt to stick to the photosensitive member 1 irrespective of the contact pressure of the cleaning blade 61 on the photosensitive member 1. Consequently, the cleaning blade 61 is apt to have a crack in the endurance test of 10K sheets.

This result indicates that the surface state of the photosensitive member 1 needs to recover to 60 degrees or more as the water contact angle by being slid once by the magnetic brush 47 in the development portion n in order to prevent the reduction in life due to the crack of the cleaning blade 61. To be more specific, the following formula is derived from the formula (3).

$$I(Dr_{Recovery}) =: -\frac{A}{X + \frac{A}{80}} + 90 \geq 60.00$$

Thus, it is understandable that it needs to be A≦48.00 (X=1) in order to remove the discharges adherent to the photosensitive member 1 and prevent the reduction in life due to the crack of the cleaning blade 61.

Table 3 summarizes representative examples of the degree of sliding S, measurement value of the water contact angle on the surface of the photosensitive member 1, and value of A (X=1) derived from the formula (3) in the case of changing the values of the above-mentioned fa($G_{SD}$), fb(M), fc(B), fd(C), fe(H), g (photosensitive member circumferential velocity) and h (photosensitive member elastic deformation ratio). The crack of the cleaning blade 61 was measured on the 10K endurance, and the blade was microscopically observed so that it is "existent" if there is even one crack leading to the toner slipping through and "none" if the number of cracks is 0. In the table, f (P) denotes the above f (magnetic brush pressure), g (circumferential velocity) denotes the above g (photosensitive member circumferential velocity), and h (elastic ratio) denotes the above h (photosensitive member elastic deformation ratio).

TABLE 3

| | Example 1 | Example 2 | Example 3 | Example 4 | Example 5 | Example 6 | Example 7 |
|---|---|---|---|---|---|---|---|
| $G_{SD}$ (μm) | 430 | 150 | 375 | 400 | 400 | 400 | 400 |
| fa (Pa) | 239.5 | 638.1 | 290.3 | 266.0 | 266.0 | 266.0 | 266.0 |
| m (emu/cm$^3$) | 200 | 285 | 200 | 200 | 160 | 160 | 200 |
| M (A/m) | $1.592 \times 10^8$ | $2.268 \times 10^8$ | $1.592 \times 10^8$ | $1.592 \times 10^8$ | $1.273 \times 10^8$ | $1.273 \times 10^8$ | $1.592 \times 10^8$ |
| fb (Pa) | 187.3 | 266.9 | 187.3 | 187.3 | 149.8 | 149.8 | 187.3 |
| b (G) | 1000 | 1100 | 997 | 1000 | 911 | 900 | 1000 |
| B (mT) | 100 | 110 | 99.7 | 100 | 91.1 | 90 | 100 |
| fc (Pa) | 187.3 | 206.0 | 186.8 | 187.3 | 170.6 | 168.6 | 187.3 |
| C (mg/cm$^2$) | 30 | 50 | 28 | 40 | 36 | 55 | 30 |
| fd (Pa) | 187.4 | 312.3 | 174.9 | 249.9 | 224.9 | 343.6 | 187.4 |
| H (deg.) | 39 | 45 | 40 | 35 | 37 | 37 | 38 |
| fe (Pa) | 162.2 | 187.1 | 166.3 | 145.5 | 153.8 | 153.8 | 158.0 |
| f (P) | 207.5 | 1666.5 | 240.2 | 275.8 | 191.2 | 288.6 | 224.5 |
| Circumferential velocity ratio(%) | 170 | 200 | 175 | 150 | 150 | 150 | 170 |
| g (circumferential velocity) | 0.7 | 1 | 0.75 | 0.5 | 0.5 | 0.5 | 0.7 |
| We (%) | 40 | 48 | 48.5 | 48.5 | 54.5 | 56 | 73 |
| h (elastic ratio) | 2.347 | $1.814 \times 10^{-1}$ | $1.546 \times 10^{-1}$ | $1.546 \times 10^{-1}$ | $2.266 \times 10^{-2}$ | $1.402 \times 10^{-2}$ | $6.086 \times 10^{-5}$ |
| S | 82773 | 60463 | 6497 | 6394 | 650 | 607 | 2 |
| Contact angle (deg.) | 89.6 | 89.5 | 85.5 | 85.4 | 60.0 | 58.7 | 10.5 |
| A | 0.3769 | 0.5160 | 4.802 | 4.879 | 48.00 | 51.39 | 13431 |
| Blade crack | None | None | None | None | None | Existent | Existent |

From the results shown in table 3, it is derived that the value of β (Sliding—Recovery correction coefficient) of $A=1/(\beta S)$ is $3.205\times10^{-5}$.

It is also understandable that the degree of sliding S needs to be 650 or more as to the sliding by the magnetic brush 47 in the development portion n in order to set the degree of recovery of the surface state of the photosensitive member 1 after passing through the development portion n once at 60.00 degrees (A=48.00) or more as the water contact angle from the state of having the adherent amount of the discharge saturated. To be more specific, if the degree of sliding S is below 650, there is a possibility that the reduction in life may occur due to the crack of the cleaning blade 61.

Thus, it is understandable from the photosensitive member surface recovery function I ($Dr_{Recovery}$) that, to prevent the reduction in life due to the crack of the cleaning blade 61, the minimum value of the degree of sliding S acquired from the photosensitive member surface recovery function I ($Dr_{Recovery}$) needs to be 650, that is, to satisfy $S \geqq 650$.

It is possible, under the conditions, to pass through the development portion n once from the state of having the adherent amount of the discharges saturated so as to remove the discharges from the photosensitive member 1 at least to the extent of causing no reduction in life due to the crack of the cleaning blade 61. It is possible, by satisfying the conditions, to prevent the reduction in the life of the cleaning blade 61. At the same time, the action of sliding of the cleaning blade 61 in the cleaning portion m works in the case where the cleaning blade 61 is provided, and so it is normally possible to eliminate an image problem such as the image deletion due to the discharges adherent to the photosensitive member 1 sufficiently from a practical viewpoint.

According to this embodiment, the contact pressure of the cleaning blade 61 on the photosensitive member 1 is 7.1 N as a lower limit of the range of the above "medium" level (7.1 to 9 N) frequently applied in practice so that the I ($Dr_{Recovery}$) having passed one rotation of the photosensitive member 1, that is, the development portion n and cleaning portion m once respectively becomes 85.47 degrees which is a level causing no image deletion. A method of evaluating the image deletion will be described later.

[III. Photosensitive Member Scratch Function J ($Dr_{scrape}$)]

Next, a detailed description will be given as to the photosensitive member scratch function J ($Dr_{scrape}$) and a method of determining a maximum value of S for generating no scratch appearing on the image from this function.

The photosensitive member scratch function J ($Dr_{scrape}$) is defined by the following formula.

$$J(Dr_{scrape})=4.8\times\exp\times(5\times10^{-5}\times S) \quad (4)$$

$J(Dr_{Scrape})$: The number of scratches appearing on the image on the 100K endurance.

Figure 14:
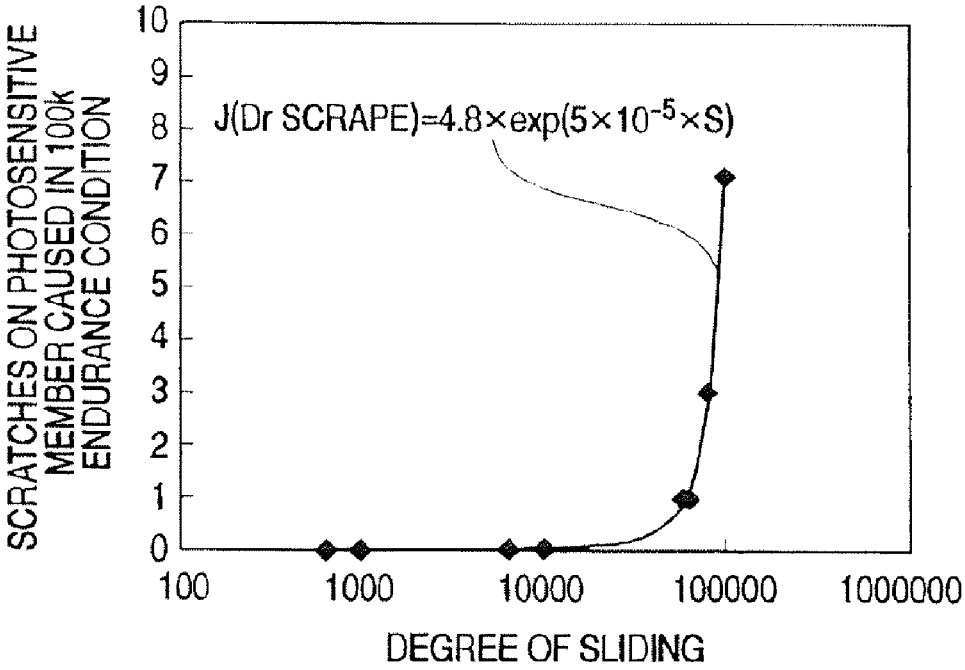
FIG. 14 is a graph chart showing a relation between a degree of sliding S and a scratch on the photosensitive member generated by 100 K endurance.

The formula (4) is derived from the result of examining the relation between the degree of sliding S and the scratches generated on the surface of the photosensitive member 1 shown in FIG. 14.

Here, the scratches on the surface of the photosensitive member 1 were measured as the number of the scratches generated on the image by performing the endurance test of 100K sheets. One white line generated on the image was counted as one scratch.

As is understandable from FIG. 14, there is a tendency that the scratches start to be generated if the degree of sliding S becomes over 60500, and the number of the scratches drastically increases if the degree of sliding is further increased.

It is understandable from the above that the degree of sliding S needs to be 60500 or less for the sake of causing no image defect due to the scratches on the photosensitive member 1, that is, the maximum value of the degree of sliding S acquired from the photosensitive member scratch function J ($Dr_{scrape}$) needs to be 60500, that is, to satisfy $S \leqq 60500$.

To summarize the above, it is possible, by setting the degree of sliding S to satisfy the formula $650 \leqq S \leqq 60500$; to remove the discharges to the extent of preventing the reduction in life due to the crack of the cleaning blade 61 and prevent the photosensitive member 1 from having a scratch while earning the life of the photosensitive member 1 by limiting the scraped-away amount thereof.

Table 4 summarizes representative examples of the degree of sliding S, measurement value of the water contact angle on the surface of the photosensitive member 1, value of A (X=1) derived from the formula (3) and measurement value of the scratch appearing on the image in the case of changing the values of the above-mentioned fa($G_{SD}$), fb(M), fc(B), fd(C), fe(H), g (photosensitive member circumferential velocity) and h (photosensitive member elastic deformation ratio). The scratch on the photosensitive member 1 was measured on the 100K endurance, and it is "existent" if there is even one scratch showing a white line on the image and "none" if there is no such scratch.

TABLE 4

| | Example 1 | Example 2 | Example 3 | Example 4 | Example 5 | Example 6 | Example 7 |
|---|---|---|---|---|---|---|---|
| $G_{SD}$ (μm) | 430 | 150 | 375 | 400 | 400 | 400 | 400 |
| fa (Pa) | 239.5 | 638.1 | 290.3 | 266.0 | 266.0 | 266.0 | 266.0 |
| m (emu/cm$^3$) | 200 | 285 | 200 | 200 | 160 | 160 | 200 |
| M (A/m) | $1.592 \times 10^8$ | $2.268 \times 10^8$ | $1.592 \times 10^8$ | $1.592 \times 10^8$ | $1.273 \times 10^8$ | $1.273 \times 10^8$ | $1.592 \times 10^8$ |
| fb (Pa) | 187.3 | 266.9 | 187.3 | 187.3 | 149.8 | 149.8 | 187.3 |
| b (G) | 1000 | 1100 | 997 | 1000 | 911 | 900 | 1000 |
| B (mT) | 100 | 110 | 99.7 | 100 | 91.1 | 90 | 100 |
| fc (Pa) | 187.3 | 206.0 | 186.8 | 187.3 | 170.6 | 168.6 | 187.3 |
| C (mg/cm$^2$) | 30 | 50 | 28 | 40 | 36 | 55 | 30 |
| fd (Pa) | 187.4 | 312.3 | 174.9 | 249.9 | 224.9 | 343.6 | 187.4 |
| H (deg.) | 39 | 45 | 40 | 35 | 37 | 37 | 38 |
| fe (Pa) | 162.2 | 187.1 | 166.3 | 145.5 | 153.8 | 153.8 | 158.0 |
| f (P) | 207.5 | 1666.5 | 240.2 | 275.8 | 191.2 | 288.6 | 224.5 |
| Circumferential velocity ratio (%) | 170 | 200 | 175 | 150 | 150 | 150 | 170 |
| g (circumferential velocity) | 0.7 | 1 | 0.75 | 0.5 | 0.5 | 0.5 | 0.7 |
| We (%) | 40 | 48 | 48.5 | 48.5 | 54.5 | 56 | 73 |
| h (elastic ratio) | 2.347 | $1.814 \times 10^{-1}$ | $1.546 \times 10^{-1}$ | $1.546 \times 10^{-1}$ | $2.266 \times 10^{-2}$ | $1.402 \times 10^{-2}$ | $6.086 \times 10^{-5}$ |
| S | 82773 | 60463 | 6497 | 6394 | 650 | 607 | 2 |
| Contact angle (deg.) | 89.6 | 89.5 | 85.5 | 85.4 | 60.0 | 58.7 | 10.5 |
| A | 0.3769 | 0.5160 | 4.802 | 4.879 | 48.00 | 51.39 | 13431 |
| Blade crack | None | None | None | None | None | Existent | Existent |
| Scratch | Existent | None | None | None | None | None | None |

From the results shown in table 4, it is understandable that the range of the degree of sliding S defined as described above is proper.

Furthermore, it is understandable from the formula (2) of the degree of sliding S that, in the case of using the photosensitive member 1 of a high elastic deformation ratio W (not easily scrapable), the magnetic brush pressure should preferably be increased to the extent of generating no scratch on the photosensitive member 1.

According to examination of the inventors hereof, it is desirable to set the gap $G_{SD}$ between the developing sleeve 42 and the photosensitive member 1 to 400 μm or less in the case of using the photosensitive member 1 of which elastic deformation ratio W is over 48 percent. The following merit can be obtained by thus narrowing the gap $G_{SD}$.

(a) 100-percent charged development can be performed to have stable colors: As developability can be rendered higher by the narrow gap $G_{SD}$, it is possible to constantly fill a latent image potential with a charge of the developer (toner) by 100 percent. Thus, there is a merit that, in the case where charge of the developer (toner) is constant, it is possible to put the developer (toner) amount commensurate with the latent potential on the photosensitive member 1 even when the gap $G_{SD}$ is varied a little so as to render the colors stable.

(b) There is no hollow character on a boundary between a solid image and a halftone image: In the case where the gap $G_{SD}$ is relatively large, there occurs a phenomenon called a hollow character in which a potential line out of the latent image curves before reaching the developing sleeve 42 as an opposed electrode and the developer (toner) of a halftone portion is drawn to a solid portion. In the case where the gap $G_{SD}$ is relatively narrow, the potential line reaches the opposed electrode before curving so that the hollow character hardly occurs.

As the gap $G_{SD}$ between the developing sleeve 42 and the photosensitive member 1 is narrowed to 400 μm or less, there is a possibility that a brush trace of the magnetic brush 47 may remain on the image due to the increasing magnetic brush pressure even though it does not lead to a scratch on the photosensitive member 1. For that reason, it is desirable, for the sake of reducing the magnetic brush pressure, to use the one having the carrier magnetic amount M (on applying a magnetic field of 100 mT) [A/m] reduced to $1.59 \times 10^8$ A/m (=200 emu/cm$^3$) or less. It is thereby possible to obtain the above merit and also obtain a high-definition image with no brush trace of the carrier. To form the magnetic brush 47 stably as previously described, however, the carrier magnetic amount M (on applying a magnetic field of 100 mT) [A/m] should be over $9.55 \times 10^7$ A/m (=120 emu/cm$^3$).

For the reason that there is a possibility that the gap $G_{SD}$ portion may be clogged with the developer, the gap $G_{SD}$ between the developing sleeve 42 and the photosensitive member 1 is over 100 μm even in the case where the elastic deformation ratio W of the photosensitive member 1 is over 48 percent.

In the case where the elastic deformation ratio W of the photosensitive member 1 is below 48 percent, the gap $G_{SD}$ between the developing sleeve 42 and the photosensitive member 1 is normally over 400 μm. This is intended to reduce the scratches generated on the photosensitive member 1 as much as possible by separating the gap $G_{SD}$. In this case, the gap $G_{SD}$ between the developing sleeve 42 and the photosensitive member 1 is normally 1000 μm or less for the reason of securing the developability (because it becomes difficult to form the development field in the gap $G_{SD}$ if overly separated)

Second Embodiment

Next, another embodiment of the present invention will be described. The elements having the same functions and configurations as those of the image forming apparatus of the first embodiment will be given the same symbols, and detailed descriptions thereof will be omitted.

According to the first embodiment, the surface state of the photosensitive member 1 recovers to 60 degrees as the water contact angle by being slid once by the magnetic brush 47 in the development portion n from the state of having the adherent amount of the discharge saturated, and the remaining discharges are removed to the level of having no image deletion by being slid by the cleaning blade 61 in the cleaning portion m. Thus, it is possible to remove the discharges from the photosensitive member 1 to the extent of preventing the reduction in life due to the crack of the cleaning blade 61. It is also possible to remove the discharges sufficiently from a practical viewpoint to the extent of causing no image problem such as the image deletion in consideration of the action of sliding of the cleaning blade 61.

In comparison, according to this embodiment, the surface state of the photosensitive member 1 recovers to the level at which no image deletion is generated only by the sliding of the magnetic brush 47 in the development portion n. Thus, it is possible, even in a cleanerless system, to remove the discharges to the extent of causing no image deletion and prevent the photosensitive member 1 from having a scratch while earning the life of the photosensitive member 1. It is also possible, as with the first embodiment, to further extend the life of the cleaning blade 61 in the system having the cleaning blade 61 provided therein.

To be more specific, instead of conventionally removing the toner remaining on the photosensitive member 1 after a transfer process with the cleaning member such as the cleaning blade 61, there is a proposal, for instance, of a cleanerless mechanism for collecting it in the developing device by means of a cover taking potential difference (potential difference between a DC voltage applied to the developing device and a surface potential of the photosensitive member) of the developing device after recharging it to a normal charging polarity with the charging means. In the case of such a cleanerless system, a primary sliding portion for the photosensitive member 1 can be only the development portion n in substance.

In the case where the surface state of the photosensitive member 1 recovers to 60 degrees or so as the water contact angle in the development portion n in the system having the cleaning blade 61 provided therein as with the first embodiment, the cleaning blade 61 has certain absorptiveness on the surface of the photosensitive member 1, where the absorptiveness of the cleaning blade 61 consisting of the elastic body such as polyurethane rubber to the photosensitive member 1 is not 0. For that reason, the sliding torque between the cleaning blade 61 and the surface of the photosensitive member 1 is relatively high, and so there are the cases where the cleaning blade 61 gets a crack on the endurance test exceeding 10K sheets. In the case where the life of the photosensitive member 1 is 100K sheets for instance, it is desirable to prevent the crack of the cleaning blade 61 so as to extend the life thereof. In the case where the photosensitive member 1 and cleaner 6 are rendered as an integral unit as a process cartridge or the like, it is important to equalize the lives of the photosensitive member 1 and the cleaning blade 61. Therefore, it is desirable to further improve the degree of recovery of the surface state of the photosensitive member 1 in the development portion n in the system having the cleaning blade 61.

In this embodiment, an examination was made as to the level at which no image deletion is generated in the cleanerless system by preparing samples of the photosensitive member 1 having varied water contact angles of 70 to 88 degrees about the degree of recovery the surface state of the photosensitive member 1 having been slid once by the magnetic brush 47 in the development portion n from the state of having the adherent amount of the discharge saturated. Table 5 shows the results. The method of measuring the water contact angles is the same as that in the first embodiment.

Here, the image deletion was evaluated by outputting 4-point characters and a binary determination was made by arbitrarily gathered 30 evaluators as to whether or not a character image is visually undesirable. As for an evaluation result, it is determined as 0 if the character is visually undesirable, and is determined as 1 if not so. "GOOD" is indicated if an average thereof is 0.9 or more, and "x" is indicated if below 0.9. The results in FIG. 5 were obtained by using the photosensitive members 1 of which elastic deformation ratios W are 40, 48 and 73 percent. The results of the image deletion were equal irrespective of the elastic deformation ratios of the photosensitive members 1. This means that the image deletion is dependent on the water contact angle. Thus, the results of the elastic deformation ratio of 48 percent are shown as representation in this case.

TABLE 5

| | Water contact angle on the photosensitive member surface | | | | | |
|---|---|---|---|---|---|---|
| | 70° | 80° | 85° | 85.47° | 87° | 90° |
| Flow | NG | NG | NG | GOOD | GOOD | GOOD |

From the results shown in FIG. 5, it is understandable that no image deletion occurs in the area where the water contact angle on the surface of the photosensitive member 1 exceeds 85.47 degrees after passing through the development portion n once from the state of having the adherent amount of the discharge saturated.

It is understandable from the above that the surface state of the photosensitive member 1 needs to recover to be over 85.47 degrees as the water contact angle by means of the sliding of the magnetic brush 47 in the development portion n. To be more specific, the following formula is derived from the formula (3).

$$I(Dr_{Recovery}) =: -\frac{A}{X+\frac{A}{80}} + 90 \geq 85.47$$

Therefore, it is understandable that it needs to be $A \leqq 4.802$ (X=1) in order to remove the discharges from the photosensitive member 1 to the extent of having no image deletion caused only by the sliding of the magnetic brush 47 in the development portion n.

Here, the value of β (sliding—recovery correction coefficient) is $3.205\times10^{-5}$ as derived in the first embodiment. Therefore, it is understandable that, as it is $A=1/(\beta S)$, the degree of sliding S needs to be 6497.5526 or more to remove the discharges from the photosensitive member 1 to the extent of having no image deletion caused only by the sliding of the magnetic brush 47 in the development portion n. From a viewpoint of securely removing the discharges, the value is rounded to set the value of the degree of sliding S slightly higher and defined it as $S \geqq 6500$.

As a result of using a relatively hard photosensitive member 1 of which elastic deformation ratio is 48 percent or more and extended life of 100K or so can be expected and checking the life of the cleaning blade at the degree of sliding S=6500, no crack of the cleaning blade 61 occurred on the 100K sheets endurance. While the crack occurred on endurance exceeding 10K sheets when the degree of sliding S=650, it was confirmed that the life was securely extended.

To summarize the above in consideration of an upper limit of the degree of sliding S acquired from the photosensitive member scratch function J ($Dr_{scrape}$) described in the first embodiment, it is possible, by setting the degree of sliding S to satisfy the formula $6500 \leqq S \leqq 60500$, to remove the discharges to the extent of causing no image deletion and prevent the photosensitive member 1 from having a scratch while earning the life of the photosensitive member 1 by limiting the scraped-away amount thereof. According to this embodiment, it is possible, even in the cleanerless system having no cleaning blade 61 provided therein, to prevent the image problem such as the image deletion caused by adherence of the discharges to the photosensitive member 1. Furthermore, according to this embodiment, it is also possible to further extend the life of the cleaning blade 61 in the system having the cleaning blade 61 provided therein.

Table 6 summarizes representative examples of the degree of sliding S, measurement value of the water contact angle on the surface of the photosensitive member 1, value of A (X=1) derived from the formula (3), measurement value of the scratch appearing on the image and measurement results of the image deletion in the case of changing the values of the above-mentioned fa ($G_{SD}$), fb(M), fc(B), fd(C), fe(H), g (photosensitive member circumferential velocity) and h (photosensitive member elastic deformation ratio). As with the above, the image deletion was evaluated by outputting 4-point characters and a binary determination was made by arbitrarily gathered 30 evaluators as to whether or not the character image is visually undesirable. As for the evaluation result, it is determined as 0 if the character is visually undesirable, and is determined as 1 otherwise. It is indicated as "existent" if the average thereof is below 0.9, and is indicated as "none" if 0.9 or more.

From the results shown in table 6, it is understandable that the range of the degree of sliding S defined as described above is proper.

Furthermore, as with the first embodiment, it is desirable to set the gap $G_{SD}$ between the developing sleeve 42 and the photosensitive member 1 to 400 μm or less in the case of using the photosensitive member 1 of which elastic deformation ratio is over 48 percent. It is thereby possible to obtain the same effect as described in the first embodiment. As with the first embodiment, in the case where the gap $G_{SD}$ between the developing sleeve 42 and the photosensitive member 1 is narrowed to 400 μm or less, it is desirable to use the one having the carrier magnetic amount M (on applying a magnetic field of 100 mT) [A/m] reduced to $1.59 \times 10^8$ A/m (=200 emu/cm$^3$) or less. It is thereby possible to obtain a high-definition image with no brush trace of the carrier.

The above described the present invention according to concrete embodiments. However, the present invention is not limited to the aspects of the embodiments. For instance, as is well known to those skilled in the art, there is an image forming apparatus having an intermediate transferring medium (such as an intermediate transferring belt) instead of a recording material bearing member of the image forming apparatus of the embodiments and adopting a method of primarily transferring the toner images formed by the image forming portions to the intermediate transferring medium to superpose them once and then secondarily transferring them collectively to the recording material. The present invention is equally applicable to such an image forming apparatus. Furthermore, there is an image forming apparatus having multiple developing devices for one image bearing member adopting a method of developing the electrostatic images sequentially formed on the image bearing member by having the multiple developing devices sequentially acting on them respectively to superpose the toner images in multiple colors on the image bearing member or sequentially transferring the toner images in multiple colors sequentially formed on the image bearing member to the recording material or the intermediate transferring medium and superposing them. The present invention is also equally applicable to such an image forming apparatus. As a matter of course, the present

TABLE 6

| | Example 1 | Example 2 | Example 3 | Example 4 | Example 5 | Example 6 | Example 7 |
|---|---|---|---|---|---|---|---|
| $G_{SD}$ (μm) | 430 | 150 | 375 | 400 | 400 | 400 | 400 |
| fa (Pa) | 239.5 | 638.1 | 290.3 | 266.0 | 266.0 | 266.0 | 266.0 |
| m (emu/cm$^3$) | 200 | 285 | 200 | 200 | 160 | 160 | 200 |
| M (A/m) | $1.592 \times 10^8$ | $2.268 \times 10^8$ | $1.592 \times 10^8$ | $1.592 \times 10^8$ | $1.273 \times 10^8$ | $1.273 \times 10^8$ | $1.592 \times 10^8$ |
| fb (Pa) | 187.3 | 266.9 | 187.3 | 187.3 | 149.8 | 149.8 | 187.3 |
| b (G) | 1000 | 1100 | 997 | 1000 | 911 | 900 | 1000 |
| B (mT) | 100 | 110 | 99.7 | 100 | 91.1 | 90 | 100 |
| fc (Pa) | 187.3 | 206.0 | 186.8 | 187.3 | 170.6 | 168.6 | 187.3 |
| C (mg/cm$^2$) | 30 | 50 | 28 | 40 | 36 | 55 | 30 |
| fd (Pa) | 187.4 | 312.3 | 174.9 | 249.9 | 224.9 | 343.6 | 187.4 |
| H (deg.) | 39 | 45 | 40 | 35 | 37 | 37 | 38 |
| fe (Pa) | 162.2 | 187.1 | 166.3 | 145.5 | 153.8 | 153.8 | 158.0 |
| f (P) | 207.5 | 1666.5 | 240.2 | 275.8 | 191.2 | 288.6 | 224.5 |
| Circumferential velocity ratio (%) | 170 | 200 | 175 | 150 | 150 | 150 | 170 |
| g (circumferential velocity) | 0.7 | 1 | 0.75 | 0.5 | 0.5 | 0.5 | 0.7 |
| We (%) | 40 | 48 | 48.5 | 48.5 | 54.5 | 56 | 73 |
| h (elastic ratio) | 2.347 | $1.814 \times 10^{-1}$ | $1.546 \times 10^{-1}$ | $1.546 \times 10^{-1}$ | $2.266 \times 10^{-2}$ | $1.402 \times 10^{-2}$ | $6.086 \times 10^{-5}$ |
| S | 82773 | 60463 | 6497 | 6394 | 650 | 607 | 2 |
| Contact angle (deg.) | 89.6 | 89.5 | 85.5 | 85.4 | 60.0 | 58.7 | 10.5 |
| A | 0.3769 | 0.5160 | 4.802 | 4.879 | 48.00 | 51.39 | 13431 |
| Image deletion | None | None | None | Existent | Existent | Existent | Existent |
| Scratch | Existent | None | None | None | None | None | None |

invention is also equally applicable to a unicolor image forming apparatus having a single image forming portion.

This application claims priority from Japanese Patent Application No. 2004-306247 filed on Oct. 20, 2004, which is hereby incorporated by reference herein.

What is claimed is:

1. An image forming apparatus comprising:

electrostatic image forming means which charges an image bearing member and forms an electrostatic image;

developing means which contacts and develops the electrostatic image with a developer including toner and carrier, wherein the developing means includes a developer bearing member which bears and carries the developer, the developer bearing member having a magnetic field generation means therein, wherein when a contact pressure of developer borne by said developer bearing member against the image bearing member is P (Pa);

a circumferential velocity of the developer bearing member is $V_{s1}$ (mm/s);

a circumferential velocity of the image bearing member is $V_{Dr}$ (mm/s); and an elastic deformation ratio of the image bearing member is W (%), and wherein an index S defined by the following formula is within a range of 650 to 60500:

$$S = P \times \left\{ \frac{|v_{S1} - v_{Dr}|}{v_{Dr}} \right\} \times \{8.50 \times 10^5 \times \exp(-0.32W)\}.$$

2. An image forming apparatus comprising:

electrostatic image forming means which charges an image bearing member and forms an electrostatic image;

developing means which contacts and develops the electrostatic image with a developer including toner and carrier, wherein the developing means includes a developer bearing member which bears and carries the developer, the developer bearing member having a magnetic field generation means inside, wherein when a gap between the developer bearing member and the image bearing member is $G_{SD}$ [μm], a magnetic amount of the carrier on applying a magnetic field of 100 mT is M[A/m];

a magnetic flux density of a magnetic pole opposed to the image bearing member provided to the magnetic field generation means is B[mT];

a developer amount per unit area on the developer bearing member is C[mg/cm$^2$];

an angle of a half-value width of the magnetic flux density of the magnetic pole opposed to the image bearing member provided to the magnetic field generation means is H[°];

a conversion coefficient is α[1/Pa$^4$];

a circumferential velocity of the developer bearing member is $V_{Sl}$ [mm/s];

a circumferential velocity of the image bearing member is $V_{Dr}$ [mm/s]; and an elastic deformation ratio of the image bearing member is W[%], wherein an index S defined by the following formula is within a range of 650 to 60500, $$S = \{fa(G_{SD}) \times fb(M) \times fc(B) \times fd(C) \times fe(H) \times \alpha\} \times \left\{ \frac{|v_{S1} - v_{Dr}|}{v_{Dr}} \right\} \times \{8.50 \times 10^5 \times \exp(-0.32W)\}$$

and wherein fa($G_{SD}$) [Pa] is equal to $1.0787315 \times 10^3 \times \exp(-3.50 \times 10^{-3} \times G_{SD})$;

fb(M) [Pa] is equal to $1.1768499 \times 10^{-6} \times M$;

fc(B) [Pa] is equal to $1.8730701 \times 10^{-2} \times B$;

fd(C) [pa] is equal to $6.246836 \times 10^{-1} \times C$;

fe(H) [Pa] is equal to $4.1580196 \times H$; and

α[1/Pa$^4$] is equal to $8.17774 \times 10^{-10}$.

3. An image forming apparatus according to claim 1, wherein the index S is 6500 or more.

4. An image forming apparatus according to claim 1, further comprising a cleaning member for removing the toner on the image bearing member by sliding the image bearing member.

5. An image forming apparatus according to claim 1, wherein the elastic deformation ratio W of the image bearing member is over 48 percent and the gap $G_{SD}$ between the developer bearing member and the image bearing member is 400 μm or less.

6. An image forming apparatus according to claim 1, wherein a magnetic amount of the carrier on applying a magnetic field of 100 mT is $1.59 \times 10^8$ A/m or less.

7. An image forming apparatus according to claim 6, wherein the magnetic amount of the carrier on applying a magnetic field of 100 mT is $9.55 \times 10^7$ A/m or more.

8. An image forming apparatus according to claim 1, wherein a magnetic flux density of a magnetic pole opposed to the image bearing member provided to the magnetic field generation means is larger than 50 mT.

9. An image forming apparatus according to claim 1, wherein a developer amount per unit area on the developer bearing member is 10 mg/cm$^2$ or more.

10. An image forming apparatus according to claim 2, wherein the index S is 6500 or more.

11. An image forming apparatus according to claim 2, further comprising a cleaning member for removing the toner on the image bearing member by sliding the image bearing member.

12. An image forming apparatus according to claim 2, wherein the elastic deformation ratio W of the image bearing member is over 48 percent and the gap $G_{SD}$ between the developer bearing member and the image bearing member is 400 μm or less.

13. An image forming apparatus according to claim 2, wherein the magnetic amount M of the carrier on applying a magnetic field of 100 mT is $1.59 \times 10^8$ A/m or less.

14. An image forming apparatus according to claim 13, wherein the magnetic amount M of the carrier on applying a magnetic field of 100 mT is $9.55 \times 10^7$ A/m or more.

15. An image forming apparatus according to claim 2, wherein the magnetic flux density B of a magnetic pole opposed to the image bearing member provided to the magnetic field generation means is larger than 50 mT.

16. An image forming apparatus according to claim 2, wherein the developer amount per unit area C on the developer bearing member is 10 mg/cm$^2$ or more.

* * * * *

UNITED STATES PATENT AND TRADEMARK OFFICE

CERTIFICATE OF CORRECTION

PATENT NO. : 7,263,318 B2
APPLICATION NO. : 11/249630
DATED : August 28, 2007
INVENTOR(S) : Tadayoshi Nishihama et al.

It is certified that error appears in the above-identified patent and that said Letters Patent is hereby corrected as shown below:

COLUMN 2:
Line 7, “an” should read --a--.

COLUMN 3:
Line 48, “Vsl” should read --$V_{sl}$--.
Line 50, “VDr” should read --$V_{Dr}$--.

COLUMN 8:
Line 39, “measure” should read --measured--.

COLUMN 13:
Line 10, “formula.” should read --formula. S=f (Magnetic brush pressure) × g (Photosensitive member circumferential velocity) × h (Photosensitive member elastic deformation ratio)--.

COLUMN 14:
Line 30, “fc (B) = $1.8730701 \times 10^2 \times B$” should read --fc (B) = $1.8730701 \times 10^{-2} \times B$--.

COLUMN 15:
Line 8, “1.5” should be deleted.

COLUMN 17:
Line 42, “the” should be deleted.

COLUMN 20:
Line 11, “and” should read --an--.

COLUMN 22:
Line 59, “650 ≦S≦60500;” should read --650 ≦S≦60500,--.

COLUMN 24:
Line 62, “separated)” should read --separated).--.

UNITED STATES PATENT AND TRADEMARK OFFICE

CERTIFICATE OF CORRECTION

PATENT NO. : 7,263,318 B2
APPLICATION NO. : 11/249630
DATED : August 28, 2007
INVENTOR(S) : Tadayoshi Nishihama et al.

It is certified that error appears in the above-identified patent and that said Letters Patent is hereby corrected as shown below:

COLUMN 29:

Line 30, "

$$S = P \times \left\{ \frac{|v_{SI} - v_{Dr}|}{v_{Dr}} \right\} \times \{8.50 \times 10^5 \times \exp(-0.32W)\}.$$

"

should read

-- $$S = P \times \left\{ \frac{|V_{SI} - V_{Dr}|}{V_{Dr}} \right\} \times \{8.50 \times 10^5 \times \exp(-0.32W)\}.$$ --

COLUMN 30:

Line 3, "

$$S = \{fa(G_{SD}) \times fb(M) \times fc(B) \times fd(C) \times fe(H) \times \alpha\} \times \left\{ \frac{|v_{SI} - v_{Dr}|}{v_{Dr}} \right\} \times \{8.50 \times 10^5 \times \exp(-0.32W)\}$$

"

should read --

$$S = \{fa(G_{SD}) \times fb(M) \times fc(B) \times fd(C) \times fe(H) \times \alpha\} \times \left\{ \frac{|V_{SI} - V_{Dr}|}{V_{Dr}} \right\} \times \{8.50 \times 10^5 \times \exp(-0.32W)\}$$

--

Line 12, "fd(C)[pa]" should read --fd(C)[Pa]--.

Signed and Sealed this

Sixth Day of May, 2008

JON W. DUDAS
*Director of the United States Patent and Trademark Office*